US006811964B2

(12) United States Patent
Sano

(10) Patent No.: US 6,811,964 B2
(45) Date of Patent: Nov. 2, 2004

(54) METHOD AND APPARATUS FOR PRODUCING COATING LIQUID FOR PHOTOTHERMOGRAPHIC MATERIAL

(75) Inventor: Yasushi Sano, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 49 days.

(21) Appl. No.: 10/396,459

(22) Filed: Mar. 26, 2003

(65) Prior Publication Data

US 2004/0191705 A1 Sep. 30, 2004

(51) Int. Cl.[7] ..... G03C 1/498; G03C 1/005

(52) U.S. Cl. ..... 430/619; 430/531; 430/567; 430/620; 430/935

(58) Field of Search ..... 430/619, 567, 430/935, 620, 531

(56) References Cited

U.S. PATENT DOCUMENTS 5,747,597 A * 5/1998 Fujita et al. ..... 525/312

6,613,504 B2 * 9/2003 Oyamada et al. ..... 430/619

FOREIGN PATENT DOCUMENTS

JP 11-133537 5/1999

JP 2002/090940 * 3/2002 ..... G03C/1/74

* cited by examiner

*Primary Examiner*—Thorl Chea

(74) *Attorney, Agent, or Firm*—Young & Thompson

(57) ABSTRACT

A coating liquid for photothermographic materials excellent in photographing performance with high sensitivity and reduced fogging and having satisfactory surface conditions is produced. A silver halide particle feeding solution is added and mixed in a mother liquid of coating liquid during a time period between the instant 30 minutes before a substrate is coated with the produced coating liquid by a coating head and the instant just before the coating is started, and in addition, an in-plant mixer is configured such that a mixing container has an inner surface of a spherical shape, an oblate-spherical shape or a prolate-spherical shape so that a mixing blade forms a mixing area in proximity to any part of the inner surface of the mixing container when a rotation axis supporting the mixing blade is driven in a reciprocal manner, whereby the mixing performance of the in-plant mixer is significantly improved.

6 Claims, 3 Drawing Sheets

METHOD AND APPARATUS FOR PRODUCING COATING LIQUID FOR PHOTOTHERMOGRAPHIC MATERIAL

BACKGROUND OF THE INVENTION

1. Field of the Invention

The present invention relates to a method and an apparatus for producing a coating liquid for photothermographic materials, and particularly relates to a technique for mixing a silver halide particle feeding solution in a mother liquid of coating liquid.

2. Description of the Related Art

For producing a photothermographic material, a solution containing an organic silver salt, a reducing agent for silver ions, a polymer latex, a spectral-sensitized silver halide particles and the like is used as a coating liquid for image formation. In this case, mother liquid of coating liquid such as the organic silver salt, the reducing agent for silver ions and the polymer latex and a silver halide particle feeding solution are prepared at different times. Japanese Patent Application Publication No. 11-133537 discloses a suitable time period during which the silver halide particle feeding solution is added to the mother liquid of coating liquid in. That is, by adding the silver halide particle feeding solution to the mother liquid of coating liquid during a time period between the instant 30 minutes before a substrate is coated with the coating liquid by a coating head and the instant just before the coating is started, a coating liquid for photothermographic materials having high sensitivity and reduced fogging can be produced. On the other hand, if the silver halide particle feeding solution is added to the mother liquid of coating before 30 minutes before the coating is started, the sensitivity is considerably reduced and the degree of fogging is increased.

However, even if the time period during which the silver halide particle feeding solution is added is defined as described above, a static type inline mixer such as a static mixer used in the conventional apparatus for producing the coating liquid for photothermographic materials has a disadvantage that it is difficult to produce a coating liquid for photothermographic materials excellent in photographing performance with high sensitivity and reduced fogging and having satisfactory coated surface conditions because sufficient mixing is hardly achieved.

For this static type inline mixer, in particular, kinetic energy of liquid that is an object to be mixed is used to promote mixing, and thus the level of mixing performance significantly depends on the properties such as viscosity of liquid (hereinafter referred to as liquid properties) and the amount of liquid delivered to the inline mixer. Therefore, in the mixing system in which the amount of liquid delivered to the inline mixer is changed depending on the coating preparation time (small amount of liquid delivered)/the coating time (large amount of liquid delivered) in the coating head as in the apparatus for producing a coating liquid for photothermographic materials, the conventional static type inline mixer cannot be used.

In addition, the coating liquid for photothermographic materials has a thixotropic characteristic, and when a strong shearing force is applied to the coating liquid, components of the coating liquid tend to coagulate. Therefore, for the inline mixer for use in the apparatus for producing the coating liquid for photothermographic materials, it is important to prevent components of the coating liquid from coagulating in addition to good mixing performance.

SUMMARY OF THE INVENTION

The present invention has been devised in view of these situations, and has as its object provision of a method and an apparatus capable of producing a coating liquid for photothermographic materials excellent in photographing performance with high sensitivity and reduced fogging and having satisfactory coated surface conditions.

In order to attain the above-described object, the present invention is directed to a method for producing a coating liquid for photothermographic materials, the method comprising the steps of: adding and mixing a silver halide particle feeding solution in a mother liquid of coating liquid containing at least an organic silver salt, a reducing agent for silver ions and a polymer latex, wherein a mixing blade is driven in a reciprocal manner so that a portion of retained liquid is eliminated for the mixing.

In order to attain the above-described object, the present invention is also directed to an apparatus for producing a coating liquid for photothermographic materials, the apparatus comprising: a feeding apparatus and an inline mixer for adding and mixing a silver halide particle feeding solution in a mother liquid of coating liquid containing at least an organic silver salt, a reducing agent for silver ions and a polymer latex, wherein the inline mixer comprising: a mixing container having an inner surface of one of a spherical shape, an oblate-spherical shape and a prolate-spherical shape; an inlet for the liquid formed in the mixing container; an outlet formed in the mixing container for discharging a mixed liquid; a mixing blade supported by a rotation axis in the mixing container and formed so that the blade has a circular or parabolic shape; and a driving device which drives the rotating axis in reciprocal manner by alternation, wherein the mixing blade forms a mixing area in proximity to any part of the inner surface of the nixing container when the rotation axis is driven.

According to the present invention, in the operation of mixing the silver halide particle feeding solution in the mother liquid of coating liquid, the inline mixer is configured so that the mixing blade forms a mixing area in proximity to any part of the inner surface of the mixing container when the mixing blade formed so that the blade has a circular or parabolic shape is driven, and the inline mixer is used, thereby achieving a significant improvement in mixing performance.

Preferably, the silver halide particle feeding solution is added and mixed in the mother liquid of coating during a time period between an instant 30 minutes before a substrate is coated with the produced coating liquid by a coating head and an instant just before the coating is started.

Preferably, a feeding pipe of the feeding apparatus is connected to an inlet pipe to the inline mixer at a position within 100 cm from the inline mixer. In this way, the mixing is carried out in the inline mixer immediately after the silver halide particle feeding solution is added to the mother liquid of coating liquid, thus making it possible to produce a coating liquid uniform in concentration, and the mother liquid of coating liquid and the silver halide particle feeding solution can sufficiently be mixed together by the inline mixer excellent in mixing performance, thus making it possible to produce a coating liquid for photothermographic materials excellent in photographing performance with high sensitivity and reduced fogging and having satisfactory coated surface conditions.

Preferably, a mixing speed of the mixing blade is in a range of from 100 to 1000 cpm. In this way, even if a coating liquid for photothermographic material which has a thixotropic characteristic and of which components tend to coagulate when a strong sheering force is applied thereto is used, sufficient mixing performance can be obtained without causing coagulation.

Preferably, the feeding apparatus has a circulation line through which the silver halide particle feeding solution is circulated. In this way, distribution of concentrations of silver halide particles in the silver halide particle feeding solution to be added can be eliminated wherever possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of the method and apparatus for producing a coating liquid for photothermographic materials according to the present invention will be described in detail below in accordance with the drawings.

Figure 1:
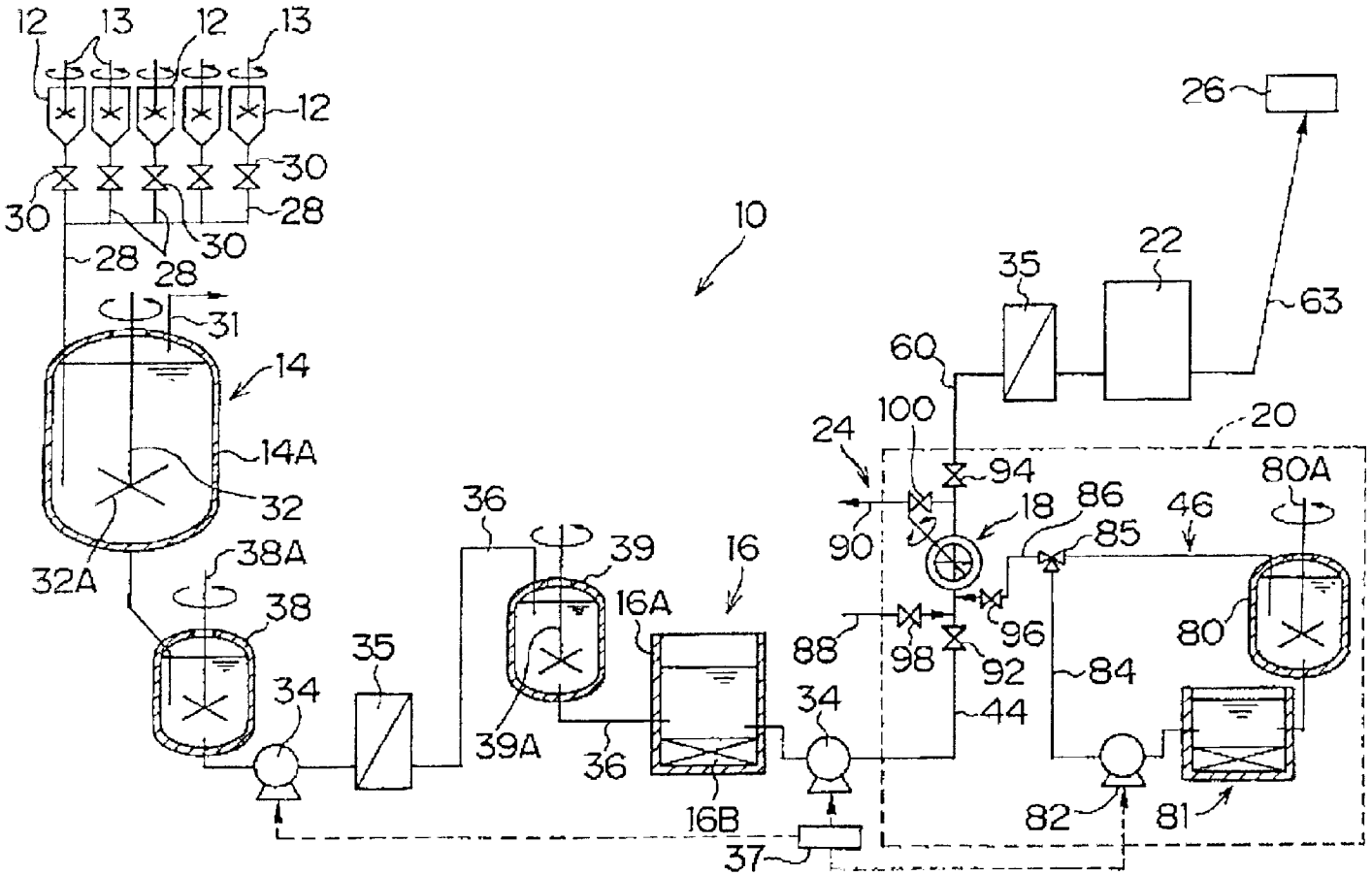
FIG. 1 is a block diagram of an apparatus for producing a coating liquid for photothermographic materials of the present invention.

FIG. 1 shows an overall configuration of the apparatus for producing a coating liquid for photothermographic materials of the present invention.

As shown in FIG. 1, a production apparatus 10 comprises a plurality of constituent liquid tanks 12, 12, . . . , a preparation and deaeration apparatus 14, an ultrasonic floatation type deaeration apparatus 16, a mixing apparatus 20 comprising an inline mixer 18, a pipeline type continuous deaeration apparatus 22 and a cleaning line 24 of the inline mixer 18, and the coating liquid produced in the production apparatus 10 is supplied to a coating head 26.

The constituent liquid tank 12 is provided with an agitator 13, and constituent liquids of coating liquid such as an organic silver salt, a reducing agent for silver ions and a polymer latex reserved in the constituent liquid tanks 12 are delivered to the preparation and deaeration apparatus 14 under their own weight by opening respective valves 30, 30, . . . provided in delivery pipes 28, 28, . . . . In this case, the constituent liquid of coating liquid may be pumped, but it is more preferable that the constituent liquid is allowed to fall under its own weight for preventing a sheering force from being applied to the liquid. The delivery pipes 28 join into one at midstream, and the outlet of the joining delivery pipe 28 extends into an agitation tank 14A of the preparation and deaeration apparatus 14.

The preparation and deaeration apparatus 14 has a closed tank type agitation tank 14A, a vacuum pipe 31 extending from a head space at the top of the agitation tank 14A is connected to a pressure reducing apparatus (not shown). In this way, in the agitation tank 14A, constituent liquids of coating liquid are mixed together under reduced pressure to prepare a mother liquid of coating liquid. For the mixing method, a known method may be used, but they are mixed at a low speed to prevent evolution of bubbles associated with agitation. FIG. 1 shows the agitation apparatus 32 using a mixing blade 32A, and a turbine blade or the like may be used as the mixing blade 32A. The mixing speed in the case of using the mixing blade is preferably such that the circumference speed is in the range of from 1 to 10 m/second. In this way, easily removable bubbles of bubbles in the coating liquid are removed to reduce a total amount of bubbles in advance by deaerating under reduced pressure performed in conjunction with preparation of the coating liquid in the agitation tank 14A.

The mother liquid of coating liquid prepared and deaerated by the preparation and deaeration apparatus 14 is temporarily reserved in a stock tank 38 with an agitator 38A, and is thereafter delivered to a stock tank 39 with an agitator 39A via a filter 35 by a delivery pump 33 of a pipe 36. For the type of delivery pump 33, a low sheering delivery pump such that a sheering force is hardly applied to the mother liquid of coating liquid is preferable and for example, a diaphragm pump, a spiral pump and the like are preferable for ensuring delivery with high accuracy. Also, the delivery pump 33 is configured so that the amount of liquid delivered can be changed by changing the speed of rotation, and is connected via a signal cable to an automatic switching device 37 described later.

Then, the mother liquid of coating liquid is delivered from the stock tank 38 through the pipe 36 to the ultrasonic floating type deaeration apparatus 16 under its own weight.

The ultrasonic floating type deaeration apparatus 16 is a tank type deaeration apparatus having an ultrasonic wave generator 16B placed in the bottom of a floatation tank 16A, and carries out deaeration by applying an ultrasonic wave to cause bubbles in the mother liquid of coating liquid to grow and gather and float to the liquid surface. For the pressure in the floatation tank 16A, either atmosphere pressure or reduced pressure is acceptable, but deaeration is more preferably carried out under reduced pressure because growing and gathering bubbles can be quickly floated to the liquid surface by producing reduced pressure. In this ultrasonic floating type deaeration apparatus 16, bubbles with relatively large sizes are removed, and deaeration time is preferably set at 1 to 60 minutes.

The mother liquid of coating liquid deaerated by the ultrasonic floatation type deaeration apparatus 16 is delivered to the mixing apparatus 20 comprising the inline mixer 18 by a delivery pump 34 of a pipe 44. For the delivery pump 34, a low sheering delivery pump is preferable and for example, a diaphragm pump, a spiral pump and the like are preferable for ensuring delivery with high accuracy as in the case of the delivery pump 33. Also, the delivery pump 34 is configured so that the amount of liquid delivered can be changed by changing the speed of rotation, and is connected via a signal cable to the automatic switching device 37 described later.

The mixing apparatus 20 comprises the inline mixer 18 and the feeding apparatus 46, and the silver halide particle feeding solution is added therein by the feeding apparatus.

Figure 2:
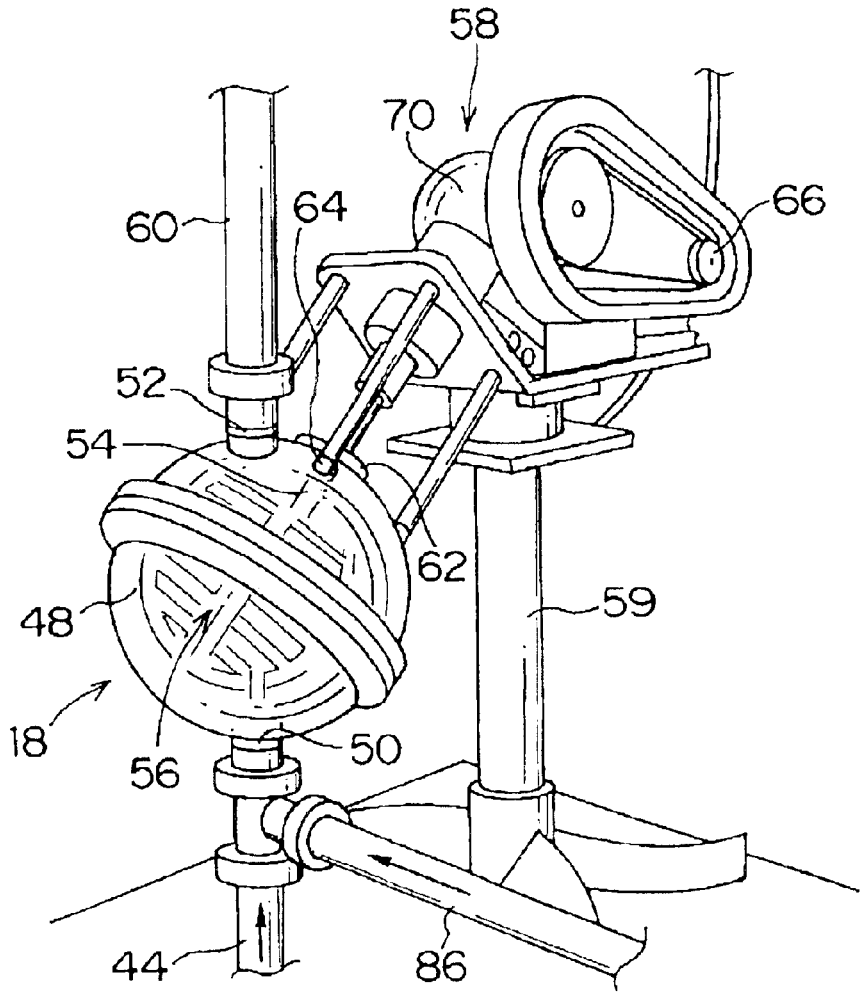
FIG. 2 is a perspective view of an inline mixer.

As shown in FIG. 2, the inline mixer 18 comprises a mixing container 48, an inlet 50 formed at the lower end of the mixing container 48, an outlet 52 formed at the upper end of the mixing container 48, a mixing blade 56 supported by a rotation axis 54, and a driving device 58 which drives the rotation axis 54 in a reciprocal manner. A pipe 44 (hereinafter referred to as an inflow pipe 44) from the ultrasonic floatation type deaeration apparatus 16 is connected to the inlet 50, a pipe 60 (hereinafter referred to as an outflow pipe 60) through which a liquid is delivered to the pipeline type continuous deaeration apparatus 22 via the filter 35 is connected to the outlet 52. Furthermore, in FIG.

2, the mixing container 48 is transparently described so that the mixing blade 56 is can be seen.

The mixing container 48 may have any shape for its outer surface, but should have a spherical shape, an oblate-spherical shape or a prolate-spherical shape at least for its inner surface. The materials of the mixing container 48 and the mixing blade 56 are not particularly limited as long as satisfactory abrasion resistance, corrosion resistance, chemical resistance and strength are ensured, but it is preferable that stainless steel materials are used and the inner surface is mirror-polished. An insertion opening 62 for inserting the rotation axis 54 is provided in the upper portion of the mixing container 48, and a seal structure supporting member 64 rotatably and sealably supporting the rotation axis 54 is provided in the insertion opening 62. The rotation axis 54 is supported in the mixing container 48 via the seal structure supporting member 64 with the rotation axis 54 inserted therein. In this case, the rotation axis 54 is placed so that the rotation axis 54 tilts relative to the straight line extending between the inlet 50 and the outlet 52 of the mixing container 48. The mixing blade 56 is supported on the part of the rotation axis 54 included in the mixing container, and the upper end of the rotation axis 54 is supported on the above described driving device 58. The tank capacity of the mixing container 48 should be capable of ensuring residence time of 5 seconds or greater. In addition, the upper limit of residence time is preferably 30 seconds, and therefore a tank capacity ensuring residence time of 5 to 30 seconds.

The driving device 58 is provided on a column 59, and comprises a motor 66 and a rotation direction converter 70. The one-way rotation by the motor 66 is converted into a reciprocal drive in which normal and reverse rotations are repeated by alternation by the rotation direction converter 70. The mixing speed (speed of rotation) by this reciprocal drive can be changed by adjusting the motor 66 by an inverter, is changed depending on mixing time or cleaning time during which the mixing container 48 and the mixing blade 56 are cleaned. The mixing speed during mixing time is in the range of 100 to 1000 cpm, preferably from 200 to 500 cpm, more preferably 250 to 350 cpm. In particular, in the case of coating liquid for photothermographic materials, the maximum mixing speed should be limited to 1000 cpm or lower because components of coating liquid tend to coagulate when a strong sheering force is applied. On the other hand, the mixing speed during cleaning time is in the range of from 300 to 1800 cpm, preferably 400 to 1500 cpm, more preferably 500 to 1000 cpm.

Figure 3:
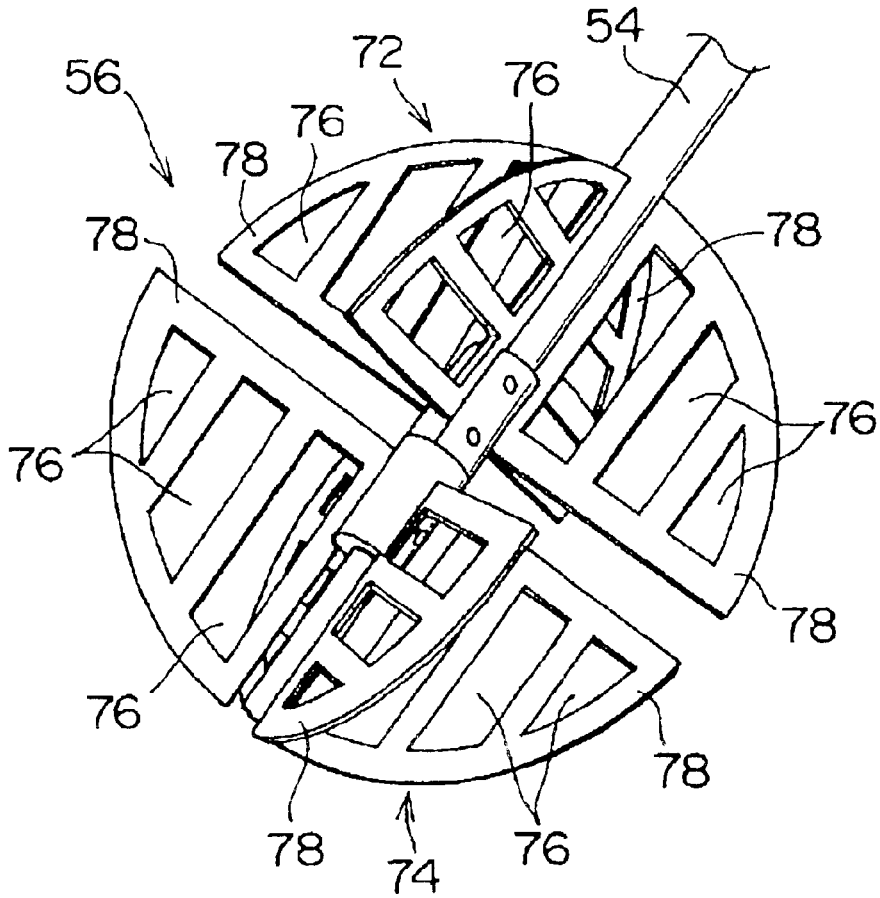
FIG. 3 is an explanatory view illustrating a mixing blade of the inline mixer.

The mixing blade 56 is formed so that the blade has a circular or parabolic shape. FIG. 3 shows an example for the circular shape wherein the mixing blade 56 is divided into an upper mixing blade 72 and a lower mixing blade 74 on upper and lower sides with respect to the rotation axis 54, and the mixing blades 72 and 74 each have four sector mixing vanes 78, 78, . . . each provided with a plurality of slits 76, 76, . . . fixed to the rotation axis 54 in the shape of a cross at intervals of an angle of 90'. Furthermore, the numbers of mixing vanes 78 of the upper mixing blade 72 and lower mixing blade 74 each may be in the range of from 2 to 8, preferably 4. Also, the upper mixing blade 72 and the lower mixing blade 74 may have different numbers of mixing vanes 78. The orientation of each mixing vane 78 is set so that the mixing blade 56 forms a mixing area in proximity to any part of the inner surface of the mixing container 48 when the rotation axis 54 is driven (see FIG. 2). That is, the orientation of the mixing vane is set so that the circular portion of the sector mixing vane 78 points upward in the upper mixing blade 72, while the circular portion of the sector mixing vane 78 points downward in the lower mixing blade 74. In addition, the mixing vane 78 of the upper mixing blade 72 and the mixing vane 78 of the lower mixing blade 74 are located at intervals of an angel of 45°, and the mixing vane 78 of the lower mixing blade 74 is located at a midpoint between the mixing vanes 78 of the upper mixing blade 72. In this case, the magnitude of the gap between the inner surface of the mixing container 48 and the mixing blade 56, namely the magnitude of the gap between the inner surface of the mixing container 48 and the circular portion of the sector mixing vane 78 is preferably in the range of from 1 to 30 mm. In this way, the mixing blade 56 is brought close to the inner surface of the mixing container 48, whereby occurrence of a dead space can be prevented during mixing time, and deposits stuck to the inner surface of the mixing container can be stripped off effectively during cleaning of the mixing container 48.

The mixing blade 56 is constituted by two types of blades, one type of blade having a plurality of slits 76 formed in the longitudinal direction, and the other type of blade having a plurality of slits 76 formed in the lateral direction, and for the four mixing vanes 78 of the upper mixing blade 72, the mixing vanes 78 having longitudinal slits 76 and the mixing vanes 78 having lateral slits 76 are placed by alternation. The same goes for the lower mixing blade 74.

As shown in FIG. 1, the feeding apparatus 46 for adding the silver halide particle feeding solution has a feeding pipe 86 branched though a three-way valve 85 from a circulation line 84 constituted by a feeding solution reservoir tank 80 with an agitator 80A, an ultrasonic floatation type deaeration apparatus 81 and a circulation pump 82. The branched feeding pipe 86 is connected to the inflow pipe 44, and the three-way valve 85 is controlled so that the feeding solution flows through the feeding pipe 86 from the circulation line 84 when the feeding solution is added, while the three-way valve 85 is controlled so that the feeding solution is circulated though the circulation Line 84 when the feeding solution is not added. Furthermore, the structure of the ultrasonic floatation type deaeration apparatus 81 is not described here because it is same as that of the above described ultrasonic floatation type deaeration apparatus denoted by designated by reference numeral 16.

The feeding pipe 86 of the feeding apparatus 46 is connected to the inflow pipe 44 at a position within 100 cm, preferably 30 cm, more preferably 10 cm from the inline mixer. Also, the circulation pump 82 is configured so that the amount of liquid delivered can be changed by changing the speed of rotation, and is connected through the signal cable to the automatic switching device 37 described later as in the case of delivery pumps 33 and 34.

The automatic switching device 37 automatically makes the switch between the mother liquid of coating liquid and the silver halide particle feeding solution depending on the coating preparation time (small amount of liquid delivered)/coating time (large amount of Liquid delivered) in the coating head 26, wherein the speeds of rotation of the delivery pumps 33 and 34 and the speed of rotation of the circulation pump 82 are switched depending on the coating preparation time or the coating time. The relation between the small amount of liquid delivered during coating preparation time or the large amount of liquid delivered during coating time and the speeds of rotation of the delivery pumps 33 and 34 and the circulation pump 82 is recognized in advance though test operations and the like. In this way, appropriate small amounts of mother liquid of coating liquid and silver halide particle feeding solution are delivered to the inline mixer 18 during coating preparation time in the coating head 26. Also, appropriate large amounts of mother liquid of coating liquid and silver halide particle feeding solution are delivered to the inline mixer 18 during coating time in the coating head 26. In this way, even in the case where the amount of liquid delivered is changed like the case of coating preparation time (small amount of liquid delivered)/coating time (large amount of liquid delivered) at the coating head 26, the mother liquid of coating liquid and the silver halide particle feeding solution can be delivered to the inline mixer 18 with high accuracy. In this case, the appropriate amounts of liquid delivered during coating preparation time and coating time may be set in the automatic switching device 37 by an operator on each occasion, or may be fixedly set in the automatic switching device 37.

The cleaning line 24 of the inline mixer 18 is constituted by a hot water line 88 connected to the inflow pipe 44 to guide hot water into the mixing container 48 and a discharge pipe 90 connected to the outflow pipe 60 to discharge cleaning waste water used for cleaning the mixing container 48 and the mixing blade 56. In addition, the inflow pipe 44, the outflow pipe 60, the feeding pipe 86, the hot water pipe 88 and the discharge pipe 90 are provided with valves 92, 94, 96, 98 and 100, respectively, and those valves are opened and closed depending on the mixing time or the cleaning time. Specifically, valves 98 and 100 are closed when the production apparatus 10 is operated, and valves 92, 94 and 96 are closed when the inline mixer 18 is cleaned.

The coating liquid mixed in the inline mixer 18 is delivered from the outflow pipe 60 through the filter 35 to the pipeline type continuous deaeration apparatus 22.

The pipeline type continuous deaeration apparatus 22 may be identical to that described in Japanese Patent Application Publication No. 53-139274, and comprises a pipeline placed along the lateral direction in an ultrasonic liquid tank and an ultrasonic vibrator provided in the bottom of the ultrasonic liquid tank, and the inlet of the pipeline is connected to the pipe 60 from the inline mixer 18, and the outlet of the pipeline is connected to the pipe 63 to the coating head 26. In this way, an ultrasonic wave emitted from the ultrasonic vibrator is propagated to the pipeline by an ultrasonic wave propagating solution, and is applied to the coating liquid flowing through the pipeline.

The operation of the production apparatus 10 configured as described above will now be described.

First, constituent liquids of coating liquid such as the organic silver salt, the reducing agent for silver ions and the polymer latex are delivered from the constituent liquid tanks 12 to the preparation and deaeration apparatus 14, where the coating liquid is prepared and deaerated. In this way, the mother liquid of coating liquid is prepared and at the same time, easily removable bubbles in the mother liquid of coating liquid are removed to reduce the total amount of bubbles in advance.

Then, in the ultrasonic floatation type deacration apparatus 16, an ultrasonic wave having a frequency of 25 kHz to 40 kHz is applied under atmospheric pressure or reduced pressure to cause bubbles in the coating liquid to grow and gather and float to the liquid surface. In this way, bubbles having relatively large sizes, of bubbles that were not removed by the preparation and deacration apparatus 14, are removed.

Then, the silver halide particle feeding solution is added to the mother liquid of coating liquid from the feeding apparatus 46 during a time period between the instant 30 minutes before the substrate is coated with the coating liquid by the coating head 26 and the instant just before the coating is started, preferably between the instant 10 minutes before the coating is started and the instant 10 seconds before the coating is started, more preferably between the instant 5 minutes before the coating is started and the instant 10 seconds before the coating is started, and then the mother liquid of coating liquid is delivered to the inline mixer 18. In this case, the feeding pipe 86 is connected to the inflow pipe 44 at a position within 100 cm, preferably 30 cm, more preferably 10 cm in the upstream from the inline mixer as described previously. In this way, the mother liquid of coating liquid and the feeding solution can immediately be mixed together into a uniform solution in the mixing container 48, thus making it possible to eliminate distribution of concentrations in the coating liquid to be produced wherever possible. Also, if liquids involving a reaction when mixed are mixed together, the reaction can be started with the liquids uniformly mixed. Therefore, the reaction can be carried out reliably, thus making it possible to prevent an unreacted liquid from flowing out from the mixing container 48. Also, the feeding apparatus 46 has the circulation line 84 through which the silver halide particle feeding solution is circulated. In this way, distribution of concentrations of silver halide particles in the silver halide particle feeding solution to be added can be eliminated wherever possible, and therefore the feeding solution containing a prescribed concentration of silver halide particles can be added with high accuracy all the time. In particular, in a system in which the amount of liquid delivered to the inline mixer 18 is changed depending on coating preparation time (small amount of liquid delivered)/coating time (large amount of liquid delivered) in the coating head 26 as in the apparatus 10 for producing a coating liquid for photothermographic materials, distribution of concentrations easily occurs due to residence of liquid in the feeding solution reservoir tank 80 during coating preparation time when a small amount of liquid is delivered, but such distribution of concentrations can be prevented by providing the circulation line 84. Also, since the ultrasonic floatation type deaeration apparatus 81 is incorporated between the feeding solution reservoir tank 80 of the circulation line 84 and the circulation pump 82, bubbles in the silver halide particle feeding solution to be added can be removed. In this way, the situation can be prevented in which bubbles are introduced in the mother liquid of coating liquid deaerated in the stage before the inline mixer 18 due to addition of the silver halide particle feeding solution.

In the inline mixer 18, the mother liquid of coating liquid and the silver halide particle feeding solution are mixed together, and thereby the coating liquid for photothermographic materials to be applied to the substrate (not shown) by the coating head 26 is prepared. As described above, components of coating liquid tend to coagulate in the case of coating liquid for photothermographic materials, and therefore the mixing speed of the mixing blade 56 is set at a relatively low speed ranging from 100 to 1000 cpm.

In this mixing, the mixing container 48 has a spherical inner surface so that the mixing blade 56 forms a spherical mixing area in proximity to the inner surface of the mixing container 48 when the rotation axis 54 supporting the mixing blade 56 is driven in a reciprocal manner to prevent occurrence of a dead space where no mixing action is exerted wherever possible, thus making it possible to improve mixing performance. Also, since the mixing blade 56 is driven in a reciprocal manner, a residence area where liquid is prevented from flowing is hardly formed in the mixing container 48 compared with one-way rotation. Further, the rotation axis 54 is made to tilt with respect to the straight line extending between the inlet 50 and the outlet 52 of the mixing container 48, thereby preventing a situation in which the direction in which the liquid flows from the outlet 52 into the mixing container 48 coincides with the direction in which the rotation axis 54 rotates. In this way, reduction in mixing performance near the rotation axis 54 can be prevented. Also, since the mixing blade 56 is divided into the upper mixing blade 72 and the lower mixing blade 74 on upper and lower sides with respect to the rotation axis 54, and the mixing vanes 78 of the mixing blades 72 and 74 are located at an angle of 45° with respect to each other, a high level of turbulence can be produced, and thus a further improvement in mixing performance can be achieved.

In this way, mixing action can be exerted effectively over the entire area of the mixing container 48, and therefore mixing performance can be improved even if the mixing speed is set at a relatively low speed of 100 to 1000 cpm as described above. Further, since a to high level of turbulence is produced in the mixing container by driving the mixing blade 56 in a reciprocal manner, the mother liquid and the feeding solution can be mixed together quickly and uniformly.

Along with such an improvement in mixing performance, the liquid flowing from the inlet 50 of the lower end of the mixing container 48 is flowed out from the outlet 52 of the upper end of the mixing container 48 while pushing up the liquid filling the mixing container 48, and therefore short pass of liquid hardly occurs in the mixing container 48. In this way, satisfactory mixing performance can be ensured even in the case of small amount of liquid delivered.

The coating-liquid prepared by mixing together the mother liquid of coating liquid and the silver halide particle feeding solution in the inline mixer 18 is delivered through the filter 35 to the pipeline type continuous deacration apparatus 22, where final deforming of the coating liquid is carried out.

In the pipeline type continuous deaeration apparatus 22, the coating liquid is continuously delivered so that a liquid surface is not created in the pipeline, and an ultrasonic wave having a frequency of 25 to 40 kHz is applied to the coating liquid flowing through the pipeline under 130 to 400 kPa of absolute pressure. In this way, bubbles with very small to small sizes which are hardly removed by the preparation and deaeration apparatus 14 and the ultrasonic floatation type deaeration apparatus 16 are dissolved in the coating liquid and removed.

The coating liquid prepared by the production apparatus 10 described above is delivered to the coating head 26 and applied to the substrate (not shown).

In this way, in the apparatus 10 for producing a coating liquid for photothermographic materials according to the present invention, when a coating liquid for photothermographic materials is produced, the silver halide particle feeding solution is mixed in the mother liquid of coating liquid during a time period between the instant 30 minutes before the substrate is coated with the produced coating liquid by the coating head 26 and the instant just before the coating is started, and in addition, the inline mixer 18 is configured such that the mixing container has a spherical inner surface so that the mixing blade forms a spherical mixing area in proximity to the inner surface of the mixing container when the rotation axis supporting the mixing blade is driven in a reciprocal manner, thereby significantly improving the mixing performance of the inline mixer 18. Further, the feeding pipe 86 of the feeding apparatus 46 to is connected to the inflow pipe 44 to the inline mixer 18 at a position within 100 cm from the inline mixer 18.

In this way, the silver halide particle feeding solution is added to the mother liquid of coating liquid, and immediately thereafter they are mixed together by the inline mixer 18, thus making it possible to produce a coating liquid uniform in concentration, and the mother liquid of coating liquid and the silver halide particle feeding solution can be mixed together sufficiently by the inline mixer 18 excellent in mixing performance, thus making it possible to produce a coating liquid for photothermographic materials excellent in photographing performance with high sensitivity and reduced fogging and having satisfactory coated surface conditions.

Generally, strong sheering force is more likely applied to the liquid in a dynamic inline mixer than in a static inline mixer, but in the dynamic inline mixer used in the production apparatus 10 in the present invention, the mixing performance can be significantly improved even if the mixing speed of the mixing blade 56 is set at a relatively low level, and therefore the liquid can be mixed sufficiently without applying a strong sheer force to the liquid.

Next, a photothermographic material preferably used in the present invention will be described in detail below.

Organic silver salts that can be used in the present invention are relatively stable to light; however, when heated to 80° C. or above in the presence of an exposed photocatalyst (latent image of light-sensitive silver halide and the like) and a reducer, they form silver images. The organic silver salts may be any organic substance containing a source that can reduce silver ions. Such non-light-sensitive organic silver salts are described in Japanese Patent Application Publication No. 10-62899, Paragraph Nos. 0048 and 0049; European Patent Application Publication No. 0803764A1, page 18, line 24 to page 19, line 37; European Patent Application Publication No. 0962812A1; Japanese Patent Application Publication No. 11-349591; Japanese Patent Application Publication No. 2000-7683; and Japanese Patent Application Publication No.2000-72711. Silver salts of organic acids, and particularly preferable are the silver salts of long-chain aliphatic carboxylic acids (of which the number of carbon atoms is 10 to 30, preferably 15 to 28). Preferable examples of the organic silver salts include silver behenate, silver arachidate, silver stearate, silver oleate, silver laurate, silver capronate, silver myristate, silver palmitate, and the mixture thereof. Of these organic silver salts, the use of an organic silver salt containing 75 mol % or more silver behenate is preferable in the present invention.

The form of the organic silver salts that can be used in the present invention is not specifically limited, and may be needle-like, bar-like, plate-like, and flake-like.

In the present invention, flake-like organic silver salts are preferable. The flake-like organic silver salts are herein defined as follows. When an organic silver salt is observed through an electron microscope, the form of a particle of the organic silver salt is approximately a rectangular parallelepiped, and when the edges of the rectangular parallelepiped are named as a, b, and c from the shortest edge (c may be the same as b), x is calculated from the shorter values a and b as follows:

$$x=b/a$$

Thus, x is calculated for about 200 particles, and when the average is called averaged value x (average), particles that satisfy the relationship of x (average)>1.5 are defined as flake-shaped. Preferably, 30≧(average)≧1.5, and more preferably, 20≧x (average)≧2.0. For reference, a needle-like particle is defined as 1≦x (average)≦1.5.

In a flake-like particle, a can be deemed as the thickness of a plate-like particle that has the face having sides b and c as the principal face. The average of a is preferably 0.01 μm to 0.23 μm, and more preferably 0.1 μm to 0.20 μm. The average of c/b is preferably 1 or more and 6 or less, more preferably 1.05 or more and 4 or less, further preferably 1.1 or more and 3 or less, and most preferably 11.1 or more and 2 or less.

The distribution of the particle sizes of the organic silver salt is preferably simple distribution. Simple distribution is the distribution when the percentage of the value obtained by dividing the standard deviations of the lengths of the minor axis and the major axis by the minor axis and the major axis, respectively, is 100% or below, more preferably 80% or below, and further preferably 50% or below. The form of the organic silver salt can be measured from the transmission electron microscope image of the dispersion of the organic silver salt. Another method for measuring simple distribution is a method to calculate the standard deviation of the volume-weighted average of the organic silver salt, and the percentage of the value obtained by dividing the standard deviation by the volume-weighted average (coefficient of variation) is preferably 100% or below, more preferably 80% or below, and further preferably 50% or below. The coefficient of variation can be obtained from the particle size (volume-weighted average diameter) obtained by radiating laser beams to the organic silver salt dispersed in a liquid, and obtaining the autocorrelation function for change in time of the wobble of the scattered light.

Known methods can be applied to the method for manufacturing an organic silver salt used in the present invention and to the method for dispersing it. For example, the above-described Japanese Patent Application Publication No. 1062899, European Patent Application Publication No. 0803764A 1, European Patent Application Publication No. 0962812A1; Japanese Patent Application Publication No. 11-349591; Japanese Patent Application Publication No. 2000-7683; and Japanese Patent Application Publication No. 2000-72711, Japanese Patent Application No. 11-348228, Japanese Patent Application No. 11-348229, Japanese Patent Application No. 11-348230, Japanese Patent Application No. 11-203413, Japanese Patent Application No. 2000-90093, Japanese Patent Application No. 2000-195621, Japanese Patent Application No. 2000-191226, Japanese Patent Application No. 2000-213813, Japanese Patent Application No. 2000-214155, Japanese Patent Application No. 2000-191226, and the like can be referred to.

If a light-sensitive silver salt is allowed to coexist when the organic silver salt is dispersed, fog increases and sensitivity lowers significantly; therefore, it is preferable not to substantially contain light-sensitive silver salts when the organic silver salt is dispersed. In the present invention, the content of light-sensitive silver salts in the aqueous dispersion is 0.1 mol % or less to 1 mole of the organic silver salt in the dispersion, and the light-sensitive silver salts are not intentionally added.

In the present invention, although a light-sensitive material can be manufactured by mixing an aqueous dispersion of an organic silver salt and an aqueous dispersion of a light-sensitive silver salt, and the mixing ratio of the organic silver salt and the light-sensitive silver salt can be selected depending on the purpose, the percentage of the light-sensitive silver salt to the organic silver salt is preferably within a range between 1 mol % and 30 mol %, more preferably within a range between 3 mol % and 20 mol %, and most preferably within a range between 5 mol % and 15 mol %. Mixing two or more aqueous dispersions of organic silver salts and two or more aqueous dispersions of light-sensitive silver salts is a method preferably used for the control of photographic performance.

Although any desired quantity of an organic silver salt can be used in the present invention, the quantity as silver is preferably 0.1 g/m$^2$ to 5 g/m$^2$, and more preferably 1 g/m$^2$ to 3 g/m$^2$.

It is preferable that the photothermographic material of the present invention contains a reducer for organic silver salts. The reducer for organic silver salts may be any substance (preferably an organic substance) that reduces silver ions to metallic silver. Such reducers are described in Japanese Patent Application Publication No. 11-65021, paragraphs 0043 to 0045; or European Patent Application Publication No. 0803764A1, page 7, line 34 to page 18, line 12. In the present invention, bisphenol reducing agents (e.g. 1,1-bis(2-hydroxy-3,5-dimethylphenyl)-3,5,5-trimethylhexane, 2,2'-methylenebis-(4-methyl-6-tcrt-butylphenol), 2,2'-methylenebis-(4-ethyl-tert-butylphenol)) are particularly preferable. The mount of added reducing agent is preferably in the range of from 0.01 to 5.0 g/m$^2$, more preferably from 0.1 to 3.0 g/m$^2$, and the content of reducing agent is preferably in the range of from 5 to 50 mol %, more preferably from 10 to 40 mol % with respect to 1 mole of silver of the surface having an image forming layer. The reducing agent is preferably incorporated in the image forming layer.

The reducer may be contained in the coating liquid and therefore in the light-sensitive material in any form, such as a dissolved form, an emulsified and dispersed form, and a dispersed fine solid particle form.

One of well-known emulsifying and dispersing methods is a method wherein a reducer is dissolved in oil, such as dibutyl phthalate, tricresyl phosphate, glyceryl triacetate, and diethyl phthalate; or an auxiliary solvent, such as ethyl acetate and cyclohexanone; and then the emulsion is mechanically formed.

Fine solid particle dispersing methods include a method wherein the powder of a reducer is dispersed in a suitable solvent, such as water, using a ball mill, a colloid mill, a vibrating ball mill, a sand mill, a jet mill, a roller mill, or ultrasonic waves to form a solid dispersion. In this time, a protective colloid (for example, polyvinyl alcohol) or a surfactant (for example, an anionic surfactant, such as sodium triisopropylnaphthalenesulfate (mixture of compounds wherein three isopropyl groups are bonded to different substitution sites)) may be used. The aqueous dispersion may contain an antiseptic agent (for example, benzoisothiazolinone sodium salt).

In the photothermographic material of the present invention, a phenol derivative represented by equation (A) described in Japanese Patent Application No. 11-73951 is preferably used as a developing accelerator.

When the reducer in the present invention has an aromatic hydroxyl group (—OH), especially in the case of the above-described bisphenols, the combined used of a non-reducing compound having groups capable of forming a hydrogen bonds with these groups is preferable. Groups that form hydrogen bonds with hydroxyl or amino groups include phosphoryl, surfoxide, sulfonyl, carbonyl, amide, ester, urethane, ureido; tertiary amino, and nitrogen-containing aromatic groups. The preferable of these are compounds having a phophoryl group, a sulfoxide group, an amide group (having no >N—H groups, and blocked as >N-Ra (Ra is a substituent other than H)), a urethane group (having no >N—H groups, and blocked as >N-Ra (Ra is a substituent other than H)), and a ureido group (having no >N—H groups, and blocked as >N-Ra (Ra is a substituent other than H)).

The particularly preferable hydrogen-bondable compound in the present invention is a compound represented by the following general formula (II).

Halogen components in light-sensitive silver halides used in the present invention are not specifically limited, and silver chloride, silver chlorobromide, silver bromide, silver iodobromide, and silver iodochlorobromide can be used. Of these, silver bromide and silver iodobromide are preferable. The halogen components in a silver halide particle may be evenly distributed, may change stepwise, or may change continuously. Silver halide particles having a core-and-shell structure may also be preferably used. The core-and-shell structure that can be used is preferably a two-layer to five-layer structure, and more preferably a two-layer to four-layer structure. The technique for allowing silver bromide to be locally present on the surfaces of silver chloride or silver chlorobromide particles can also be preferably used.

Methods for forming light-sensitive silver halide are well known to the skilled in the art, and the method described in Research Disclosure, No. 17029, June 1978 and U.S. Pat. No. 3,700,458 can be used. Specifically, a light-sensitive silver halide is formed by adding a silver-providing compound and a halogen-providing compound in a solution of gelatin or other polymers, and then it is mixed with an organic silver salt. Also preferably used are method described in Japanese Patent Application Publication No. 11-119374, paragraphs 0217 to 0224, and Japanese Patent Application Nos. 11-98708 and 2000-42336.

It is preferably that the particle size of the light sensitive silver halide is small for inhibiting clouding after forming images. Specifically, it is preferably 0.2 $\mu$m or smaller, more preferably 0.01 $\mu$m or larger and 0.15 $\mu$m or smaller, and most preferably 0.02 $\mu$m or larger and 0.12 $\mu$m or smaller. The particle size mentioned here refers to a diameter equivalent to that of a ball having a volume equivalent to that of the silver halide particle if the silver halide particle is so called a normal crystal having a shape of cube or octahedron, or a non-normal crystal, for example, a spherical particle and a rod particle, and refers to a diameter equivalent to that of a circular image having of which the area equals the projected arca of the main surface if the silver halide particle is a flat particle.

The shapes of the silver halide particles include cubic, octahedral, tabular, spherical, rod-like, and potato-like. In the present invention, cubic particles are particularly preferable. Silver halide particles having rounded corners can also be preferably used. The plane index (Miller index) of the outer surfaces of light-sensitive silver halide particles is not specifically limited, however, it is preferable that the percentage of {100} planes, which has a high spectral sensitization efficiency when spectral sensitization dyes are adsorbed, is high. The percentage is preferably 50% or more, more preferably 65% or more, and most preferably 80% or more. The Miller index, the percentage of {100} planes, can be obtained using the method that utilizes the adsorption dependency of {111} planes and {100} planes in the adsorption of the sensitizing dyes, described in T. Tani; J. Imaging Sci., 29, 165 (1985).

The light-sensitive silver halide particles of the present invention can contain metals or metal complexes of groups 8 to 10 in the periodic table (from group 1 to group 18). The preferable metals in metals or metal complexes of groups 8 to 10 are rhodium, ruthenium, and iridium. These metal complexes may be used alone, or in combination of two or more metals of the same group or of different groups. The content is preferably within a range between $1\times10^{-9}$ mole and $1\times10^{-3}$ mole to 1 mole of the silver. These heavy metals, metal complexes, and methods for the addition thereof are described in Japanese Patent Application Publication No. 7-225449; Japanese Patent Application Publication No. 11-65021, paragraph Nos. 0018 to 0024; and Japanese Patent Application Publication No. 11-119374, paragraph Nos. 0227 to 0240.

In the present invention, the iridium compound is particularly preferably incorporated in the silver halide particle. Iridium compounds include, for example, hexachloro iridium, hexamine iridium, trioxalate iridium and hexacyano iridium. The iridium compound is dissolved in water or an appropriate solvent and used, but a method usually used for stabilizing a solution of iridium compound, namely a method of adding a solution of halogenated hydrogen (e.g. hydrochloric acid, bromic acid and fluoric acid) or a method of adding a halogenated alkali (e.g., KCl, NaCl, KBr and NaBr) may be used. Other silver halide particles doped with iridium in advance may be added and dissolved in place of water soluble iridium when silver halide is prepared. The amount of iridium added is preferably in the range of from $1\times10^{-8}$ to $1\times10^{-3}$ mole, more preferably from $1\times10^{-7}$ to $5\times10^{-4}$ mole with respect to 1 mole of silver halide. Furthermore, metal atoms (for example, $[Fe(CN)_6]$) that can be contained in silver halide particles used in the present invention, and the desalination and chemical sensitization of silver halide emulsions are described in Japanese Patent Application Publication No. 11-84574, paragraph Nos. 0046 to 0050; Japanese Patent Application Publication No. 11-65021, paragraph Nos. 0025 to 0031; and Japanese Patent Application Publication No. 11-119374, paragraph Nos. 0242 to 0250.

Various types of gelatin can be used as the gelatin contained in the Light-sensitive silver halide emulsion used in the present invention. In order to maintain the dispersion of the light-sensitive silver halide emulsion in an organic-silver-salt-containing coating liquid, the use of a low-molecular-weight gelatin of a molecular weight of 500 to 60,000 is preferable. Although such a low-molecular-weight gelatin may be used when the particles are formed, or dispersed after desalination treatment, it is preferable to use when the particles are dispersed after desalination treatment.

As a sensitizing dye that can be used in the present invention, a sensitizing dye that can spectrally sensitize silver halide particles in a desired wave-length region when adsorbed on the silver halide particles, and that has a spectral sensitivity commensurate with the spectral properties of the exposing light source can be chosen advantageously. Sensitizing dyes and method for adding are described in Japanese Patent Application Publication No. 11-65021, paragraphs 0103 to 0109; a compound represented by general formula (II) in Japanese Patent Application Publication No. 10-186572; a dye represented by general formula (1) in Japanese Patent Application Publication No. 11-119374, paragraph 0106; U.S. Pat. No. 5,510,236; a dye described in Example 5 of U.S. Pat. No. 3,871,887; a dye disclosed in Japanese Patent Application Publication No. 2-96131 and No. 59-48753; European Patent Application Publication No. 0803764A1, page 19, line 38 to page 20, line 35; Japanese Patent Application Nos. 2000-86865, 2000-102560, and 2000-205399. These sensitizing dyes may be used alone, or may be used in combination of two or more dyes. In the present invention, the time for adding the sensitizing dye in the silver halide emulsion is preferably after the desalination step up to application, and more preferably after the desalination step and before starting chemical aging.

Although the quantity of the sensitizing dye in the present invention can be any desired quantity to meet the properties of sensitivity or fog, the quantity for 1 mole of the silver halide in the light-sensitive layer is preferably $10^{-6}$ mole to 1 mole, and more preferably $10^{-4}$ mole to $10^{-1}$ mole.

It is preferable that the light-sensitive silver halide particles in the present invention are chemically sensitized by sulfur sensitization, "selenium" sensitization, or tellurium sensitization. Compounds preferably used in sulfur sensitization, selenium sensitization, and tellurium sensitization are well known to those skilled in the art, and include, for example, a compound described in Japanese Patent Application Publication No.7-128768. Particularly in the present invention, tellurium sensitization is preferable, and the compounds described in Japanese Patent Application Publication No. 11-65021, paragraph 0030, and the compounds represented by general formulas (II), (III), and (IV) in Japanese Patent Application Publication No.5-313284 are preferably used.

In the present invention, chemical sensitization can be performed at any time after the formation of particles and before application, and specifically, it can be performed after desalination and (1) before spectral sensitization, (2) at the same time of spectral sensitization, (3) after spectral sensitization, and (4) immediately before application. In particular, it is preferable that chemical sensitization is performed after spectral sensitization.

Although the quantity of sulfur, selenium, and tellurium sensitizers used in the present invention varies depending on silver halide particles used, or the conditions of chemical aging, the quantity for 1 mole of the silver halide is usually $10^{-8}$ mole to $10^{-2}$ mole, and preferably $10^{-7}$ mole to $10^{-3}$ mole. Although the conditions of chemical sensitization in the present invention are not specifically limited, the pH is preferably 5 to 8, the pAg is preferably 6 to 11, and the temperature is preferably 40° C. to 95° C.

To the silver halide emulsion used in the present invention, a thiosulfonate compound may be added using the method disclosed in European Patent Application Publication No. 293,917.

The light-sensitive silver halide emulsion in the light-sensitive material used in the present invention can be used alone, or two or more light-sensitive silver halide emulsions (for example, of different average particle sizes, different halogen compositions, different crystal habits, or different conditions of chemical sensitization) can be used in combination. The use of a plurality of light-sensitive silver halides of different sensitivities can control the tone. These techniques are disclosed in Japanese Patent Application Publication Nos. 57-119341, 53-106125, 47-3929,48-55730, 46-5187, 50-73627, and 57-150841. The difference in sensitivity of each emulsion is preferably 0.2 log E or more.

The quantity of the light-sensitive silver halide in terms of the quantity of coating silver for 1 $m^2$ of the light-sensitive material is preferably 0.03 $g/m^2$ to 0.6 $g/m^2$, more preferably 0.07 $g/m^2$ to 0.4 $g/m^2$, and most preferably 0.05 $g/m^2$ to 0.3 $g/m^2$. To 1 mole of the organic silver salt, the quantity of the light-sensitive silver halide is preferably 0.01 mole or more and 0.5 mole or less, and more preferably 0.02 mole or more and 0.3 mole or less.

The methods and conditions for mixing the light-sensitive silver halide and the organic silver salt separately prepared include a method for mixing the prepared silver halide particles and the organic silver salt using a high-speed agitator, a ball mill, a sand mill, a colloid mill, a vibrating mill, or a homogenizer; or a method for mixing the prepared light-sensitive silver halide in some timing during the preparation of the organic silver salt; however, the method is not limited to a specific method as long as the effect of the present invention is obviously obtained. Mixing two or more aqueous dispersions of organic silver salt and two or more aqueous dispersions of light-sensitive silver salt is a preferable method for controlling photographic properties.

Although the time for adding the silver halide in a coating liquid for image forming layers in the present invention is 180 minutes before application to immediately before application, preferably 60 minutes to 10 seconds before application, a method and a condition for mixing are not specifically limited as long as the effect of the present invention is obviously obtained. Specific mixing methods include a method of mixing in a tank wherein the average retention time calculated from the flow rate and the quantity to the coater is controlled to a desired time; or a method to use a static mixer described in N. Hamby, M. F. Edwards, and A. W. Nienow, "Liquid Mixing Techniques", translated by Koji Takahashi, Nikkan Kogyo Shimbun (1989), Chapter 8.

The binder of an organic-silver-salt-containing layer of the present invention may be any polymer, and preferable binders are transparent or translucent, and are generally colorless. They include natural resins, polymers, and copolymers; synthetic resins, polymers, and copolymers; and other media forming films, for example, gelatins, rubbers, polyvinyl alcohols, hydroxyethyl cellulose, cellulose acetate, cellulose acetate butylate, polyvinyl pirrolidone, casein, starch, polyacrylate, polymethyl methacrylate, polyvinyl chloride, polymethacrylate, styrene-maleic anhydride copolymers, styrene-acrylonitrile copolymers, styrene-butadiene copolymers, polyvinyl acetal (for example, polyvinyl methylal and polyvinyl butylal), polyesters, polyurethane, phenoxy resins, polyvinylidene chloride, polyepoxide, polycarbonate, polyvinyl acetate, polyolefins, cellulose esters, and polyamides. The binders may also be formed by coating from water, organic solvents, or emulsions.

In the present invention, the performance is improved when the organic-silver-salt-containing layer is formed by coating with a coating liquid containing a solvent whose 30% by mass or more is water, and drying; furthermore, when the binder of the organic-silver-salt-containing layer is soluble or dispersible in a water-based solvent (aqueous solvent); and particularly when the binder is composed of a polymer latex having an equilibrium moisture content at 25° C. and 60% RH of 2% by mass or less. The most preferable aspect is prepared so that the ion conductivity becomes 2.5 mS/cm or below. The methods for preparing such an aspect include purification treatment of the synthesized polymer using a membrane having an isolating function.

The water-based solvent wherein the polymer is soluble or dispersible used herein is water, or the mixture of water and 70% by mass or less water-miscible organic solvent. Water-miscible organic solvents include, for example, alcohols, such as methyl alcohol, ethyl alcohol, and propyl alcohol; cellosolves, such as methyl cellosolve, ethyl cellosolve, and butyl cellosolve; ethyl acetate; and dimethyl formrnamide.

In the case of a system wherein the polymer is not thermodynamically dissolved, and is present in a so-called dispersed state, the term of a water-based solvent is used here.

The "equilibrium moisture content at 25° C. and 60% RH" is represented by the following equation using the mass of the polymer W1 in a humidity-controlled equilibrium under an atmosphere of 25° C. and 60% RH, and the mass of the polymer W0 in the absolute dry condition at 25° C.

$$\text{Equilibrium moisture content at 25° C. and 60\% RH} = \{(W1-W0)/W0\} \times 100 \text{ (\% by mass)}$$

The definition and the measuring method of moisture content can be referred to, for example, Polymer Engineering Seminar 14, Methods for Testing Polymers (Society of Polymer Science, Japan, Chijin Shokan).

The equilibrium moisture content at 25° C. and 60% RH of the binder polymer of the present invention is preferably 2% by mass or less, more preferably 0.01% by mass or more and 1.5% by mass or less, and most preferably 0.02% by mass or more and 1% by mass or less.

In the present invention, a polymer that is dispersible in a water-based solvent is particularly preferable. Examples of dispersed states include a latex wherein fine particles of a hydrophobic polymer insoluble in water are dispersed, and a dispersion of polymer molecules in a molecular state or in a micelle state, both of which are preferable. The average particle diameter of the dispersed particles is preferably within a range between 1 nm and 50,000 nm, and more preferably within a range between 5 nm and 1,000 nm. The particle diameter distribution of the dispersed particles is not specifically limited, and the dispersed particles may have a wide particle diameter distribution or a monodisperse particle diameter distribution.

In the present invention, preferred aspects of polymers dispersible in water-based solvents include hydrophobic polymers, such as acrylic polymers, polyesters, rubber (for example, SBR resin), polyurethane, polyvinyl chloride, polyvinyl acetate, polyvinylidene chloride, and polyolefins. These polymers may be straight-chain polymers, branched polymers or cross-linked polymers; may be homopolymers wherein a single type of monomers are polymerized; or may be copolymers wherein two or more types of monomers are polymerized. The copolymers may be random copolymers, or may be block copolymers. The molecular weight (number average molecular weight) of these polymers is 5,000 to 1,000,000, preferably 10,000 to 200,000. If the molecular weight is too low, the mechanical strength of the emulsion layer is insufficient; and if the molecular weight is too high, the film forming capability becomes poor.

Specific examples of preferable latexes are listed below. The list shows material monomers, the unit of values in parentheses is % by mass, and molecular weights are number average molecular weights. In the case of polyfunctional monomers, since the concept of molecular weight cannot be applied because they form cross-linked structures, they are described as "cross-linkable", and the description of molecular weights is omitted. Tg denotes glass transition temperature.

P-1; -MMA (70)-EA (27)-MAA (3)-latex (molecular weight: 37,000)

P-2; -MMA (70)-2EHA (20)-St (5)-AA (5)-latex (molecular weight: 40,000)

P-3; -St (50)-Bu (47)-MAA (3)-latex (cross-linkable)

P-4; -St (68)-Bu (29)-AA (3)-latex (cross-linkable)

P-5; -St (71)-Bu (26)-AA (3)-latex (cross-linkable, Tg 24° C.)

P-6; -St (70)-Bu (27)-LA (3)-latex (cross-linkable)

P-7; -St (75)-Bu (24)-AA (I)-latex (cross-linkable)

P-8; -St (60)-Bu (35)-DVB (3)-MAA (2)-latex (cross-linkable)

P-9; -St (70)-Bu (25)-DVB (2)-AA (3)-latex (cross-linkable)

P-10; -VC (50)-MMA (20)-EA (20)-AN (5)-AA (3)-latex (molecular weight: 80,000)

P-11; -VDC (85)-MMA (5)-EA (5)-MAA (5)-latex (molecular weight: 67,000)

P-12; -Et (90)-MMA (10)-latex (molecular weight: 12,000)

P-13; -St (70)-2EHA (27)-AA (3)-latex (molecular weight: 130,000)

P-14; -MMA (63)-EA (35)-AA (2)-latex (molecular weight: 33,000)

P-15; -St (70.5)-Bu (26.5)-AA (3)-latex (cross-linkable, Tg 23° C.)

P-16; -St (69.5)-Bu (27.5)-AA (3)latex (cross-linkable, Tg 20.5° C.)

Abbreviations in the above-described structures denote the following monomers: MMA: methyl methacrylate, EA: ethyl acrylate, MAA: methacrylic acid, 2EHLA: 2-ethylhexyl acrylate, St: styrene, Bu: butadiene, AA: acrylic acid, DVB: divinyl benzene, VC: vinyl chloride, AN: acrylonitrile, VDC: vinylidene chloride, Et: ethylene, IA: itaconic acid.

The above-described polymer latexes are also sold in the market, and the following polymers are commercially available. Examples of acrylic polymers include Cevian A-4635, 4718, and 4601 (Daicel Chemical Industries) and Nipol Lx 811, 814, 821, 820, and 857 (ZEON Corporation); examples of polyesters include FINETEX ES 650, 611, 675, and 850 (Dainippon Ink and Chemicals, Inc.) and WD-size and WMS (Eastman Chemical); examples of polyurethane include HYDRAN AP 10, 20, 30, and 40 (Dainippon Ink and Chemicals, Inc.); examples of rubbers include LACSTAR 7301K, 3307B, 4700H, and 7132C (Dainippon Ink and Chemicals, Inc.) and Nipol Lx 416, 410, 438C, and 2507 (ZEON Corporation); examples of polyvinyl chloride include G351 and G576 (ZEON Corporation); examples of polyvinylidene chloride include L502 and L513 (Asahi Kasei); and examples of polyolefins include Chemipearl S120 and SA100 (Mitsui Chemicals).

These polymer latexes may be used alone, or may be used in combination of two or more as required.

The polymer latex preferably used in the present invention is latex of a styrene-butadiene copolymer. The mass ratio of styrene monomer units to butadiene monomer units in the styrene-butadiene copolymer is preferably 40:60 to 95:5. The proportion of styrene monomer units and butadiene monomer units in the copolymer is preferably 60% by mass to 99% by mass. The preferable molecular weight range is the same as described above.

Latexes of styrene-butadiene copolymers preferably used in the present invention include the above-described P-3 to P-8, P-14, P-15, commercially available LACSTAR-3307B, 7132C, and Nipol Lx 416.

In the organic-silver-salt-containing layer of the light-sensitive material of the present invention, hydrophilic polymers, such as gelatin, polyvinyl alcohol, methylcellulose, hydroxypropyl cellulose, and carboxymethyl cellulose may be added as required. The content of these hydrophilic polymers in the total quantity of binders in the organic-silver-salt-containing layer is preferably 30% by mass or less, and more preferably 20% by mass or less.

The organic-silver-salt-containing layer (image forming layer) of the present invention is preferably formed from polymer latex. The mass ratio of the total quantity of the binder to the organic silver salt in the organic-silver-salt-containing layer is within a range between 1/10 and 10/1, preferably 1/5 and 4/1.

Such an organic-silver-salt-containing layer is normally a light-sensitive layer (emulsion layer) containing light-sensitive silver halide, which is a light-sensitive silver salt, and in this case, the mass ratio of total binders to the silver halide is within a range between 400 and 5, preferably 200 to 10.

The total quantity of the binder in the image-forming layer of the present invention is within a range between 0.2 $\mu m^2$ and 30 $g/m^2$, preferably between 1 $g/m^2$ and 15 $g/m^2$. In the image-forming layer of the present invention, a cross-linking agent for cross-linking, and a surfactant for improving coating properties may be added.

In the present invention, the solvent (here, a solvent and a dispersant are collectively referred to as solvent for simplification) in the coating liquid for the organic-silver-salt-containing layer of the light-sensitive layer in the present invention is preferably a water-based solvent containing 30% by mass or more water. The components other than water may be any optional water-miscible organic solvents, such as methyl alcohol, ethyl alcohol, isopropyl alcohol, methyl cellosolve, ethyl cellosolve, dimethyl formamide and ethyl acetate. The water content in the solvent of the coating liquid is preferably 50% by mass or more, and more preferably 70% by mass or more. The preferable examples of solvent compositions are water, water/methyl alcohol=90/10, water/methyl alcohol=70/30, water/methyl alcohol/dimethyl formamide=80/15/5, water/methyl alcohol/ethyl cellosolve=85/10/5, and water/methyl alcohovisopropyl alcohol=85/10/5 (unit: % by mass).

The anti-fog agent, stabilizer, and precursor for the stabilizer that can be used in the present invention include compounds described in Japanese Patent Application Publication No. 10-62899, paragraph 0070, European Patent Application Publication No. 0803764A1, page 20, line 57 to page 21, line 7, and Japanese Patent Application Publication Nos. 9-281637 and 9-329864. The anti-fog agents preferably used in the present invention are organic halogen compounds, and are disclosed in Japanese Patent Application Publication No. 11-65021, paragraphs 0111 to 0112. The organic halogen compounds represented by formula (P) of Japanese Patent Application No. 11-87297, the organic polyhalogen compound represented by general formula (II) of Japanese Patent Application Publication No. 10-339934, and the organic polyhalogen compounds described in Japanese Patent Application No. 11-205330 are particularly preferable.

In the present invention, the methods for containing an anti-fog agent in the light-sensitive material include the method described in the above-described method for containing the reducer, and the addition of fine solid particles is also preferable for the organic polyhalogen compound.

Other anti-fog agents include the mercury (II) salt in Japanese Patent Application Publication No. 11-65021, paragraph 0113, benzoates in Japanese Patent Application Publication No. 11-65021, paragraph 0114, salicylic acid derivatives in Japanese Patent Application Publication No. 2000-206642, formalin scavenger compounds represented by formula (S) in Japanese Patent Application Publication No. 2000-221634, triazine compounds according to claim 9 of Japanese Patent Application Publication No. 11-352624, the compounds represented by general formula (III) of Japanese Patent Application Publication No. 6-11791, and 4-hydroxy-6-methyl-1,3,3a,7-tetrazaindene.

The photothermographic material of the present invention may contain an azolium salt for the purpose of preventing fog. The azolium salts include the compounds represented by general formula (XI) described in Japanese Patent Application Publication No. 59-193447, the compound described in Japanese Patent publication No. 55-12581, and the compounds represented by general formula (II) described in Japanese Patent Application Publication No. 60-153039. Although the azolium salt can be added to any positions in the light-sensitive material, addition to the layer on the surface having the light-sensitive layer is preferable, and addition to the organic-silver-salt-containing layer is more preferable. Although the azolium salt can be added in any steps for the preparation of the coating liquid, and when it is added to the organic-silver-salt-containing layer, it can be added in any steps from the time for the preparation of the organic silver salt to the preparation of the coating liquid, and preferably the time after the preparation of the organic silver salt to immediately before coating. The azolium salt may be added in any forms, such as powder, a solution, and a dispersion of fine particles. It may also be added as a solution whereto other additives, such as a sensitizing dye, a reducer, and toning agent, are added. In the present invention, although the quantity of the azolium salt to be added may be optional, it is preferably $1\times10^{-6}$ mole or more and 2 moles or less, and more preferably $1\times10^{-3}$ mole or more and 0.5 moles or less to 1 mole of silver.

In the present invention, a mercapto compound, a disulfide compound, and a thion compound may be contained for inhibiting, accelerating, or controlling development; for improving the efficiency of spectral sensitization; and for improving storage stability before and after development. The specific examples are described in Japanese Patent Application Publication No.10-62899, paragraphs 0067 to 0069; the compounds represented by general formula (1) of Japanese Patent Application Publication No. 10-186572, and paragraphs 0033 to 0052; European Patent Application Publication No. 0803764A1, page 20, lines 36 to 56; and Japanese Patent Application No. 11-273670. Above all, a mercapto-substituted heterocyclic aromatic compound is preferable.

In the present invention, a compound having a phosphoryl group is preferably used, and phosphine oxides are particularly preferable. Specifically, these compounds include triphenylphosphine oxide, tri-(4-methylphenyl) phosphine oxide, tri-(4-methoxyphenyl) phosphine oxide, tri-(t-butylphenyl) phosphine oxide, tri-(3-methylphenyl) phosphine oxide and trioctylphosophine oxide. The compound having a phosphoryl group of the present invention can be introduced in a sensitive material in the same way as the reducing agent and polyhalogen compound. The content of compound having a phosphoryl group of the present invention is preferably in the range of from 0.1 to 10, more preferably from 0.1 to 2.0 with respect to the ratio of added reducing agent (molar ratio). It is more preferably in the range of from 0.2 to 1.0.

In the photothermographic material of the present invention, the addition of a toning agent is preferable. Toning agents are described in Japanese Patent Application Publication No. 10-62899, paragraph Nos. 0054 and 0055; European Patent Application Publication No. 0803764A1, page 21, lines 23 to 48; Japanese Patent Application Publication No. 2000-356317; and Japanese Patent Application No. 2000-187298. Particularly preferable are phthaladinones (phthaladinone, phthaladinone derivatives, or metal salts; for example, 4-(1-naphthyl) phthaladinone, 6-chlorophthaladinone, 5,7-dimethoxyphthaladinone, and 2,3-dihydro-1,4-phthaladinedione); the combination of phthaladinones and phthalates (for example, phthalic acid, 4-methyl phthalic acid, 4-nitro phthalic acid, diammonium phthalate, sodium phthalate, potassium phthalate, and tetrachloro phtalic anhydride); phthaladines (phthaladine, phthaladine derivatives, or metal salts; for example, 4-(1-naphthyl) phthaladine, 6-isopropyl phthaladine, 6-t-butyl phthaladine, 6-chloro phthaladine, 5,7-dimethoxy phthaladine, and 2,3-dihydro phthaladine); and the combination of phthaladines and phthalates. Of these, the combination of phthaladines and phthalates is most preferable. Plasticizers and lubricants that can be used in the light-sensitive layers of the present invention are described in Japanese Patent Application Publication No. 11-65021, paragraph 0117; the super-high contract agents for forming super-high contract images, and the method of addition and quantity thereof are described in Japanese Patent Application Publication No. 11-65021, paragraph 0118; Japanese Patent Application Publication No. 11-223898, paragraphs 0136 to 0193; Japanese Patent Application No. 11-87297, compounds of formulas (H), (1) to (3), (A), and (B); Japanese Patent Application No. 11-91652, compounds of general formulas (III) to (V) (specific compounds: compounds 21 to 24); and high-contrast promoters are described in Japanese Patent Application Publication No. 11-65021, paragraph 0102, and Japanese Patent Application Publication No. 11-223898, paragraphs 0194 and 0195.

In order to use formic acid or a formate as a strong fogging substance, it is preferably contained in the side having an image-forming layer that contains the light-sensitive silver halide in a quantity of 5 mmol or less for 1 mole of silver, more preferably 1 mmol or less.

When an ultra-high contrast agent is used in the photothermographic material of the present invention, it is preferable to use in combination with an acid or the salt thereof formed by hydrating diphosphorus pentaoxide. The acids or the salts thereof formed by hydrating diphosphorus pentaoxide include metaphosphoric acid (metaphosphorates), pyrophosphoric acid (pyrophosphorates), orthophosphoric acid (orthophosphorates), triphosphoric acid (triphosphorates), tetraphosphoric acid (tetraphosphorates), and hexametaphosphoric acid (hexametaphosphorates). Particularly preferable acids or the salts thereof formed by hydrating diphosphorus pentaoxide are orthophosphoric acid (orthophosphorates), and hexametaphosphoric acid (hexametaphosphorates). Specific salts include sodium orthophosphorate, dihydrogen sodium orthophosphorate, sodium hexametaphosphorate, and ammonium hexametaphosphorate.

Although the quantity (coating quantity for 1 $m^2$ of the light-sensitive material) of acids or the salts thereof formed by hydrating diphosphorus pentaoxide may be as desired depending on the performance, such as sensitivity and fog, it is preferably 0.1 $mg/m^2$ to 500 $mg/m^2$, and more preferably 0.5 $mg/m^2$ to 100 $mg/m^2$.

The photothermographic material of the present invention may have a surface-protecting layer for the purpose of preventing the adherence of the image-forming layer. The surface-protecting layer may be of a single layer, or may be of multiple layers. The surface-protecting layer is described in Japanese Patent Application Publication No. 11-65021, paragraphs 0119 to 0120, and Japanese Patent Application No. 2000-171936.

Although gelatin is preferably used for the binder of the surface-protecting layer of the present invention, it is also preferable to use or to combine polyvinyl alcohol (PVA). Gelatin that can be used include inert gelatin (for example, Nitta Gelatin 750) and phthalated gelatin (for example, Nitta Gelatin 801). PVA that can be used is described in Japanese Patent Application Publication No. 2000-171936, paragraphs 0009 to 0020, and fully saponified PVA-105, partially saponified PVA-205, PVA-335, and modified polyvinyl alcohol MP-203 (KURARAY) are preferably used. The quantity of polyvinyl alcohol coating as the protecting layer (per layer) (per 1 $m^2$ of the support) is preferably 0.3 $g/m^2$ to 4.0 $g/m^2$, and more preferably 0.3 $g/m^2$ to 2.0 $g/m^2$.

Particularly, when the photothermographic material of the present invention is used for printing, wherein change in dimensions raises problems, the use of polymer latex in the surface-protecting layer or the backing layer is preferable. Such polymer latexes are described in Taira Okuda and Hiroshi Inagaki, "Synthetic Resin Emulsion", Kobunshi Kankoukai (1978); Takaaki Sugimura, Yasuo Kataoka, Soichi Suzuki, and Keiji Kasahara, "Application of Polymer Latex", Kobunshi Kankoukai (1993); and Soichi Muroi, "Chemstry of Polymer Latex", Kobunshi Kankoukai (1970). Specifically, the polymer latexes include a latex of methyl methacrylate (33.5% by mass)/ethyl acrylate (50% by mass)/methacrylic acid (16.5% by mass) copolymer; a latex of methyl methacrylate (47.5% by mass)/butadiene (47.5% by mass)/itaconic acid (5% by mass) copolymer; a latex of ethyl acrylate/metacrylic acid copolymer; a latex of methyl methacrylate (58.9% by mass)/2-etylhexyl acrylate (25.4% by mass)/styrene (8.6% by mass)/2-hydroxyethyl methacrylate (5.1% by mass)/acrylic acid (2.0% by mass) copolymer, and a latex of methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer. Furthermore, the combination of polymer latexes described in Japanese Patent Application No. 11-6872, the technique described in Japanese Patent Application No. 11-143058, paragraphs 0021 to 0025; the technique described in Japanese Patent Application No. 11-6872, paragraphs 0027 to 0028; and the technique described in Japanese Patent Application No. 10-199626, paragraphs 0023 to 0041 can be applied to binders for surface-protecting layer. The content of the polymer latex for surface-protecting layer is preferably 10% by mass to 90% by mass of the total binder, more preferably 20% by mass to 80% by mass.

The quantity of the total binders (including water-soluble polymers and latex polymers) of the surface-protecting layer (per layer) (per 1 $m^2$ of the support) is preferably 0.3 $g/m^2$ to 5.0 $g/m^2$, and more preferably 0.3 $g/m^2$ to 2.0 $g/m^2$.

The temperature in the preparation of the coating liquid for the image-forming layer in the present invention is 30° C. or above and 6° C. or below, preferably 35° C. or above and below 60° C., and more preferably 35° C. or above and 55° C. or below. It is also preferable that the temperature of the coating liquid for the image-forming layer immediately after the addition of polymer latex is maintained at 30° C. or above and 65° C. or below.

The organic silver salt-containing fluid or thermal image forming layer coating liquid in the present invention is preferably so called a thixotropic fluid. The thixotropic characteristic refers to a nature such that viscosity is reduced as the sheering speed increases. Any apparatus may be used for measuring viscosity in the present invention, but RFS Fluid Spectrometer manufactured by Rheometric Far East Co., Ltd. is preferably used, and viscosity is measured at 25° C. The viscosity of the organic silver salt-containing fluid or thermal image forming layer coating liquid at the sheering speed of 0.1 $s^{-1}$ in the present invention is preferably in the range of from 400 mPa·s to 100,000 mPa·s inclusive, more preferably from 500 mPa·s to 20,000 mPa·s inclusive. Also, the viscosity is preferably in the range of from 1 mPa·s to 200 mPa·s inclusive, further preferably from 5 mPa·s to 80 mPa·s inclusive at the sheering speed of 1000 $s^{-1}$.

A various kinds of systems expressing the thixotropic characteristic are known, and they are described in "Course: Rheology" edited by Polymer Journal Press, "Polymer latex" (Polymer Journal Press) by Muroi and Morino in collaboration. The fluid should contain a large amount of solid fine particles for expressing the thixotropic characteristic. In addition, for enhancing the thixotropic characteristic, it can be achieved effectively by incorporating a viscosity improving linear polymer, increasing the aspect ratio with irregular shapes of contained solid fine particles, using an alkali viscosity improver and a surfactant, and so on.

The image-forming layer of the present invention is composed of one or more layer on the support. When it is composed of one layer, the layer comprises an organic silver salt, light-sensitive silver halide, a reducer, and a binder, and as required, contains additional materials, such as a toning agent, covering additives and other auxiliary agents. When it is composed of two or more layers, the first image-forming layer (normally the layer contacting the support) must contain an organic silver salt and light-sensitive silver halide, and the second image-forming layer or both layers must contain other several components. The constitution of a multicolor photothermographic material may contain the combination of these two layers for each color, and all the components may be contained in a single layer, as described in U.S. Pat. No. 4,708,928. In the case of a multi-dye multicolor photothermographic material, each emulsion layer is separated from each other and maintained by using a functional or non-functional barrier layer between each light-sensitive layer, as described in U.S. Pat. No. 4,460,681.

Various dyes or pigments (for example, C. I. Pigment Blue 60, C. I. Pigment Blue 64, and C.I. Pigment Blue 15:6) can be used in the light-sensitive layer of the present invention from the pint of view of improving color tone, preventing the occurrence of interference fringes in exposing a laser beam, and preventing irradiation. These are described in WO 98/36322, and Japanese Patent Application Publication Nos. 10-268465 and 11-338098.

In the photothermographic material of the present invention, an anti-halation layer can be provided on the side of light-sensitive layer remote from the light source.

A photothermographic material has generally non-light-sensitive layers in addition to a light-sensitive layer. Non-light-sensitive layers can be classified according to the location thereof into (1) a protecting layer provided on the light-sensitive layer (remote side from the support), (2) an intermediate layer provided between a plurality of light-sensitive layers or between the light-sensitive layer and the protecting layer, (3) a primer layer provided between the light-sensitive layer and the support, and (4) a backing layer provided on the side opposite to the light-sensitive layer. A filter layer is provided on the light-sensitive layer as the layer (1) or (2). The anti-halation layer is provided on the light-sensitive layer as the layer (3) or (4).

Anti-halation layers are described in, for example, Japanese Patent Application Publication No. 11-65021, paragraphs 0123 and 0124; Japanese Patent Application Publication Nos. 11-223898,9-230531, 10-36695, 10-104779, 11-231457, 11-352625, and 11-352626.

The anti-halation layer contains an anti-halation dye having absorption in the exposure wavelength. When the exposure wavelength is in the infrared region, an infrared absorbing dye can be used, and in this case, the dye that has no absorption in the visible region is preferable.

If halation is prevented using a dye having absorption in the visible region, it is preferable that the color of the dye does not substantially remain after forming images, a means to vanish the color with the heat of thermal development is used, and in particular, a thermally achromatizing dye and a base precursor are added to a non-light-sensitive layer to function as an anti-halation layer. These techniques are described in Japanese Patent Application Publication No. 11-231457.

The quantity of the achromatizing dye is determined according to the use of the dye. In general, it is used in a quantity that the optical density (absorbance) measured by the objective wavelength exceeds 0.1. The optical density is preferably 0.2 to 2. The quantity of the dye for obtaining such an optical density is generally approximately 0.001 $g/m^2$ to 1 $g/m^2$.

When the dye is achromatized, the optical density after thermal development can be lowered to 0.1 or less. Two or more achromatizing dyes may be used in combination in a thermally achromatizing recording material or a photothermographic material. Similarly, two or more base precursors may be used in combination.

In thermal achromatizing using such achromatizing dyes and base precursors, the combination use of a substance that lowers the melting point by 3 degrees or more by mixing with a base precursor such as described in Japanese Patent Application Publication No. 11-352626 (for example, diphenylsulfone and 4-chloroprene (phenyl) sulfide) is preferable from the point of view of thermal achromatizing.

In the present invention, for the purpose of improving change by aging of the silver color tone and the images, a colorant having an absorption maximum at 300 nm to 450 nm can be added. Such a colorant is described, for example, in Japanese Patent Application Publication Nos. 62-210458, 63-104046, 63-103235, 63-208846, 63-306436, 63-314535, 01-61745, and Japanese Patent Application No.11-276751. Such a colorant is normally added within a range between 0.1 $mg/m^2$ and 1 $mg/m^2$, and the layer for the addition of the colorant is preferably the back layer provided opposite to the light-sensitive layer.

The photothermographic material in the present invention is preferably a one-sided light-sensitive material having at least one light-sensitive layer containing a silver halide emulsion on one side of the support, and having a backing layer on the other side.

In the present invention, it is preferable to add a mat agent for improving conveying properties, and the mat agent is described in Japanese Patent Application Publication No. 11-65021, paragraphs 0126 to 0127. The quantity of the mat agent coating for 1 $m^2$ of the light-sensitive material is preferably 1 $mg/m^2$ to 400 $mg/m^2$, and more preferably 5 $mg/m^2$ to 300 $mg/m^2$.

Although any mat degree of the emulsion surface is optional unless stardust defects occur, the Peck flatness is preferably 30 seconds or more and 2,000 seconds or less, and more preferably 40 seconds or more and 1,500 seconds or less. The Peck flatness can be obtained in accordance with Japanese Industrial Standards (JIS) P8119, "Method for Testing Flatness of Paper and Cardboard Using Peck Tester", and TAPIR Standard Method T479.

In the present invention, the Peck flatness for a mat degree of the backing layer is preferably 1,200 seconds or less and 10 seconds or more, more preferably 800 seconds or less and 20 seconds or more, and most preferably 500 seconds or less and 40 seconds or more.

In the present invention, the matting agent is preferably contained in the outermost surface layer of the light-sensitive layer or a layer that functions as the outermost surface layer, a layer close to the outer surface, or a layer that functions as the protecting layer.

The backing layer that can be applied to the present invention is described in Japanese Patent Application Publication No. 11-65021, paragraphs 0128 to 0130.

For the photothermographic material in the present invention, pH of the film surface before heat development processing is preferably 6.0 or lower, more preferably 5.5 or lower. The lower limit thereof is not particularly limited, but is considered as low as about 3. For adjustment of pH of the film surface, an organic acid such as a phthalic acid derivative, a non-volatile acid such as sulfuric acid and a volatile base such as ammonium are preferably used in the sense that pH of the film surface is reduced. Particularly, ammonium is preferable in achieving a low level of pH of the film surface because it is highly volatile and thus can be removed before a step of coating and heat development is carried out. Furthermore, the method of measuring pH of the film surface is described in the paragraph No. 0123 of Japanese Patent Application Publication No. 11-87297.

In the layers of the present invention, such as light-sensitive layer, the protecting layer, and the backing layer, a hardener can be used. Examples of hardeners include methods described in T. H. James, "The Theory of the Photographic Process, Fourth Edition", Macmillan Publishing Co. Inc, (1977), pages 77 to 87; and chrome alum, 2,4-dichloro-6-hydroxy-s-triazine sodium salt, N,N-ethylene bis (vinylsulfone acetamide), and N,N-propylene bis (vinylsulfone acetamide); as well as multivalent metal ions described in page 78 of the same reference book; polyisocyanates described in U.S. Pat. No. 4,281,060 and Japanese Patent Application Publication No. 6-208193; epoxy compounds described in U.S. Pat. No. 4,791,042; and vinylsulfone-based compounds described in Japanese Patent Application Publication No. 62-89048 are preferably used.

The hardener is added in the form of a solution, and the time for adding the solution to the coating liquid for the protecting layer is 180 minutes before to immediately before coating, preferably 60 minutes to 10 seconds before coating. The methods and conditions for mixing are not specifically limited as long as the effect of the present invention is sufficiently achieved. Specific methods for mixing include a method of mixing in a tank wherein the average retention time calculated from the flow rate and the quantity to the coater is controlled to a desired time; or a method to use a static mixer described in N. Harnby, M. F. Edwards, and A. W. Nienow, "Liquid Mixing Techniques", translated by Koji Takahashi, Nikkan Kogyo Shimbun (1989), Chapter 8.

The surfactants, the solvent, the support, the anti-static or conductive layer, and the method for obtaining color images that can be used in the present invention are disclosed in Japanese Patent Application Publication No. 11-65021, paragraph 0132, 0133, 0134, 0135, and 0136, respectively; and the lubricants are described in Japanese Patent Application Publication No.11-84573, paragraphs 0061 to 0064, and Japanese Patent Application No. 11-106881, paragraphs 0049 to 0062.

For a transparent support, polyester, especially polyethylene terephthalate undergone heat treatment within a temperature range between 130° C. and 185° C. is preferably used for relieving internal strain remaining in the film during biaxial drawing, and eliminating thermal shrinkage strain occurring during thermal development. In the case of a photothermographic material, the transparent support may be colored with a blue dye (for example, dye-1 described in Japanese Patent Application Publication No. 8-240877), or may be not colored. It is preferable that the primer techniques of water-soluble polyester described in Japanese Patent Application Publication No. 11-84574, styrene-butadiene copolymer described in Japanese Patent Application Publication No. 10-186565, and vinylidene chloride copolymers described in Japanese Patent Application Publication No. 2000-39684 and Japanese Patent Application No. 11-106881, paragraphs 0063 to 0080 are applied to the support. To the antistatic layers or the primers, the techniques described in Japanese Patent Application Publication Nos. 56-143430, 56-143431, 58-62646,56-120519, and 11-84573, paragraphs 0040 to 0051, U.S. Pat. No. 5,575,957, and Japanese Patent Application Publication No. 11-223898, paragraphs 0078 to 0084 can be applied.

The photothermographic material is preferably of a monosheet type (a type that can form images on a photothermographic material not using other sheets as in image-receiving materials).

To the photothermographic material, an anti-oxidant, a stabilizer, a plasticizer, an ultraviolet absorber, or coating additives may further be added. The various additives are added to either the light-sensitive layer or a non-light-sensitive layer. These are described in WO 98/36322, EP 803764A1, Japanese Patent Application Publication Nos. 10-186567 and 10-18568.

The photothermographic material in the present invention can be applied using any methods. Specifically, various coating operations can be used, including extrusion coating, slide coating, curtain coating, dip coating, knife coating, flow coating, and extrusion coating using a hopper of a type described in U.S. Pat. No. 2,681,294. Extrusion coating described in Stephen F. Kistler, Petert M. Schweizer, "Liquid Film Coating", (Chapman & Hall, 1997), pages 399 to 536, or slide coating are preferably used, and slide coating is most preferably used. An example of a form of slide coaters used for slide coating is shown in FIG. 11*b*.1 in page 427 of the above-described reference. If desired, two or more layers can be applied simultaneously using the methods described in pages 399 to 536 of the above-described reference, U.S. Pat. No. 2,761,791, and British Patent No. 837,095.

Techniques that can be used in the photothermographic material of the present invention are also described in EP 803764A1, EP 883022A1, WO 98/36322, Japanese Patent Application Publication Nos. 56-62648, 58-62644, 943766, 9–281637, 9-297367, 9-304869, 9-311405, 9-329865, 10-10669, 10-62899, 10-69023, 10-186568, 10-90823, 10-171063, 10-186565, 10-186567, 10-186569,10-186570, 10-186571, 10-186572, 10-197974, 10-197982, 10-197983, 10-197985, 10-197986, 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536, 11-133537, 11-133538, 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, Japanese Patent Application Nos. 2000-187298, 2000-10229, 2000-47345, 2000-206642, 2000-98530, 2000-98531, 2000-112059, 2000-112060, 2000-112104, 2000-112064, 2000-171936, and 11-282190.

The photothermographic material of the present invention may be developed using any methods, and normally, it is developed by heating the photothermographic material exposed image-wise. The developing temperature is preferably 80° C. to 250° C., and more preferably 100° C. to 140° C. The developing time is preferably 1 second to 180 seconds, more preferably 10 seconds to 90 seconds, and most preferably 10 seconds to 40 seconds.

The preferable system for thermal development is a plate-heater system. The preferable thermal development system by a plate-heater system is a system described in Japanese Patent Application Publication No. 11-133572, which is a thermal development system for obtaining visible images by contacting a photothermographic material wherein a latent image has been formed with a heating means in the thermal development section. The thermal development system is characterized in that the heating means comprises a plate heater, a plurality of presser rollers are disposed facing and along a surface of the plate heater, and the photothermographic material is passed between the presser rollers and the plate heater to perform thermal development. It is preferable that the plate heater is divided into two to six stages, and that the temperature of the end portion is lowered by 1 to 10° C. Such a method, also described in Japanese Patent Application Publication No. 54-30032, can exclude moisture or organic solvents contained in the photothermographic material out of the system, and the deformation of the support of the photothermographic material suddenly heated can be prevented.

Although the light-sensitive material of the present invention can be exposed using any methods, a preferable light source for exposure is laser beams. The preferable laser beams for the present invention include gas laser ($Ar^+$, He—Ne), YAG laser, dye laser, and semiconductor laser. A semiconductor laser and a second higher-harmonic-generating element can also be used. Red to infrared emitting gas or a semiconductor laser is preferable.

Laser imagers for medical use having an exposure section and a thermal development section include Fuji Medical Dry Laser Imager FM-DP L. The FM-DP L is described in Fuji Medical Review No. 8, pages 39 to 55, and these techniques can be applied to the laser imager of the photothermographic material of the present invention. These techniques can also be applied to the photothermographic material for the laser imager in "AD network" proposed by Fuji Medical System as a network system meeting the DICOM Standards.

The photothermographic material of the present invention forms black-and-white images by silver images, and is preferably used in the photothermographic material for medical diagnostics, the photothermographic material for industrial photography, the photothermographic material for printing, and the photothermographic material for COM.

(Fabrication of PET Support)

Using terephthalic acid and ethylene glycol, PET having an intrinsic viscosity (IV) of 0.66 (measured in a mixed solvent of phenol and tetrachloroethane (6:4 by mass) at 25° C.) was obtained according to a normal method. This was palletized, dried at 130° C. for 4 hours, melted at 300° C., extruded through a T-die, and quenched to form a non-oriented film of a thickness after heat fixing of 175 μm.

This film was longitudinally stretched 3.3 times using rolls of different circumferential speed, and transversally stretched 4.5 times using a tenter. The temperatures for stretching were 110° C. and 130° C., respectively. Thereafter, the film was heat-fixed at 240° C. for 20 seconds, and relaxed by 4% in the transverse direction at the same temperature. Then, the portion of the film held by the chuck of the tenter was cut off, the both edges were knurled, the film was wound at 4 kg/cm$^{D2}$ to obtain a roll of the film having a thickness of 175 μm.

(Corona Treatment of Surface)

The both surfaces of the support were treated using a 6-kVA solid-state corona treatment system of Piller Inc. at room temperature at 20 m/min. From the readings of current and voltage, it was known that the support was treated at 0.375 kV·A·min/m$^2$. The treatment frequency was 9.6 kHz, and the gap clearance between the electrode and the dielectric roller was 1.6 mm.

| (Fabrication of primer coating support)<br>(1) Preparation of primer coating liquid | |
|---|---|
| Formulation (for primer-coating layer in the light-sensitive layer side) | |
| Pesresin A-515GB (30% by mass solution) (Takamatsu Oil & Fat) | 234 g |
| Polyethylene glycol monononyl phenyl ether | 21.5 g |

-continued

| (Fabrication of primer coating support)<br>(1) Preparation of primer coating liquid | |
|---|---|
| (average ethylene oxide number = 8.5) (10% by mass solution) | |
| MP-1000 (Soken Chemical & Engineering) (polymer fine particles, average particle diameter: 0.4 μm) | 0.91 g |
| Distilled water | 744 mL |
| Formulation (for first layer in back surface) | |
| Styrene-butadiene copolymer latex (solid content: 40% by mass, styrene/butadiene mass ratio: 68/32) | 158 g |
| 2,4-dichloro-6-hydroxy-S-triazine, sodium salt (8% by mass aqueous solution) | 20 g |
| Sodium laurylbenzenesulfonate (1% by mass aqueous solution) | 10 mL |
| Distilled water | 854 mL |
| Formulation (for second layer in back surface) | |
| $SnO_2$/SbO (9/1 mass ratio, average particle diameter: 0.038 μm, 17 mass % dispersion) | 84 g |
| Gelatin (10% by mass aqueous solution) | 89.2 g |
| Metolose TC-5 (2% by mass aqueous solution) (Shin-Etsu Chemical) | 8.6 g |
| MP-1000 (Soken Chemical & Engineering) | 0.01 g |
| Sodium dodecylbenzene sulfonate (1% by mass aqueous solution) | 10 mL |
| NaOH (1% by mass) | 6 mL |
| Prokicell (ICI) | 1 mL |
| Distilled water | 805 mL |

After the both surfaces of the above-described biaxially oriented polyethylene terephthalate support having a thickness of 175 μm was subjected to the above-described corona discharge treatment, one surface (light-sensitive layer side) was coated with the primer coating liquid of the above-described formulation with a wire bar so that the wet coating quantity became 6.6 ml/m$^2$ (per surface), and dried at 180° C. for 5 minutes. Then, the other surface (back face) was coated with the primer coating liquid of above-described formulation with a wire bar so that the wet coating quantity became 5.7 mL/m$^2$, and dried at 180° C. for 5 minutes. Furthermore, the other surface (back face) was coated with the primer coating liquid of above-described formulation with a wire bar so that the wet coating quantity became 7.7 mL/m$^2$, and dried at 180° C. for 6 minutes to fabricate a primer coated support.

(Preparation of Back Surface Coating Liquid)

(Preparation of Solid Fine Particle Dispersion of Base Precursor (a))

64 g of base precursor compound 11, 28 g of diphenylsulfone and 10 g of surfactant Detnor N manufactured by Kao Corp. were mixed with 220 ml of distilled water, and the mixture was bead-dispersed using a sand mill (¼ Gallon Sand Grinder Mill manufactured by IMEX Co., Ltd.) to obtain a solid fine particle dispersion base precursor compound (a) having an average particle size of 0.2 μm.

(Preparation of Dye Solid Fine Particle Dispersion)

9.6 g of cyanine dye compound 13 and 5.8 g of sodium P-dodecylbenzenesulfonate were mixed with 305 ml of distilled water, and the mixture was bead-dispersed using a sand mill (¼ Gallon Sand Grinder Mill manufactured by IMEX Co., Ltd.) to obtain a dye solid fine particle dispersion having an average particle size of 0.2 μm.

(Preparation of Antihalation Layer Coating Liquid)

17 g of gelatin, 9.6 g of polyacrylamide, 70 g of solid fine particle dispersion base precursor compound (a) described above, 56 g of dye solid fine particle dispersion described above, 1.5 g of polymethyl methacrylate fine particles (average particle size of 6.5 μm), 0.03 g of benzoisothiazolinone, 2.2 g of sodium polyethylenesulfonate, 0.2 g of blue dye compound 14, 3.9 g of yellow dye compound 15 and 844 ml of water were mixed together to prepare an antihalation layer coating liquid.

(Preparation of Back Face Protecting Layer)

50 g of gelatin, 0.2 g of sodium polystyrenesulfonate, 2.4 g of N,N-ethylenebis (vinylsulfoneacetoamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethyleneglycolmono (N-perfluorooctylsulfonyl-N-propyl-2-aminoethyl) ether (average polymerization degree of ethylene oxide: 15), 32 mg of $CgFl_7SO_3K$, 64 mg of $C_8F_{17}SO_2N(C_3H_7)(CH_2CH_2O)_4(CH_2)_4$—$SO_3Na$, 8.8 g of acrylic acid/ethyleneacrylate copolymer (weight ratio of copolymer: 5/95), 0.6 g of aerosol OT (manufactured by American Thianamide Co., Ltd.), 1.8 g of liquid paraffin emulsion as a liquid paraffin and 950 ml of water were mixed together with the container kept at 40° C. to prepare a back face protecting layer.

<Preparation of Silver Halide Emulsion 1>

A solution prepared by adding 3.1 ml of 1 wt % potassium bromide solution to 1421 ml of distilled water and then adding thereto 3.5 ml of 1 mol/L sulfuric acid and 31.7 g of phtalated gelatin was kept at 34° C. while it was stirred in a stainless reaction jar coated with titanium, and a solution A prepared by adding distilled water to 22.22 g of silver nitrite so that it was diluted to 95.4 ml and a solution B prepared by diluting 15.9 g of potassium bromide to 97.4 ml with distilled water were fully added thereto at a fixed flow rate for 45 seconds. Thereafter, 10 ml of 3.5 wt % hydrogen peroxide aqueous solution was added, and then 10.8 ml of 10 wt % benzoimidazole aqueous solution was added. Then, a solution C prepared by adding distilled water to 51.86 g of silver nitrate so that it was diluted to 317.5 ml was fully added at a fixed flow rate for 20 minutes, while a solution D prepared by diluting 45.8 g of potassium bromide to 400 ml with distilled water was added by a control double jet method while keeping pAg at 8.1. Potassium iridium (III) hexachloride was fully added so that its concentration was $1\times10^{-4}$ mole with respect to 1 mole of silver 10 minutes after the solutions C and D started being added. In addition, an aqueous solution of potassium iron (II) hexacyanide was fully added in the amount of $3\times10^{-4}$ mole with respect to 1 mole of silver 5 seconds after the addition of the solution C was completed. pH is adjusted to 3.8 using 0.5 mol/L sulfuric acid, stirring was stopped, and precipitation, desalination and rinsing steps were carried out. pH was adjusted to 5.9 using 1 mol/L sodium hydroxide to prepare a silver halide dispersion with pAg of 8.0.

The silver halide dispersion was kept at 38° C. while it was stirred, and 5 ml of 0.34 wt % methanol solution of 1,2-benzoisothiazoline-3-on was added, and after 40 minutes a methanol solution of spectrum sensitizing pigment A was added in the amount of $1\times10^{-3}$ mole with respect to 1 mole of silver, and after 1 minute the mixture was heated to 47° C. 20 minutes after the temperature was raised, sodium benzenethiosulfonate was added with a methanol solution in the amount of $7.6\times10^{-5}$ mole with respect to 1 mole of silver, and after 5 minutes a tellurium sensitizer B was added with a methanol solution in the amount of $1.9\times10^{-4}$ mole with respect to 1 mole of silver, and was left for aging for 91 minutes. 1.3 ml of 0.8 wt % methanol solution of N,N'-dihydroxy-N"-diethylmelamine was added, and after 4 minutes 5-methyl-2-mercaptobenzoimidazole was added with a methanol solution in the amount of $3.7\times10^{-3}$ mole with respect to 1 mole of silver and l-phenyl-2-heptyl-5-mercapto-1,3,4-triazole was added with a methanol solution in the amount of $4.9\times10^{-3}$ mole with respect to 1 mole of silver to prepare a silver halide emulsion 1.

Particles in the prepared silver halide emulsion were pure silver bromide particles having a ball-equivalent average size of 0.046 μm and a ball-equivalent coefficient of size variation of 20%. The particle size and the like were determined from the average size of 1000 particles using an electron microscope. The {100} plane ratio of the particles was determined to be 80% using the Kubelka-Munk method.

<Preparation of Silver Halide Emulsion 2>

A silver halide emulsion 2 was prepared in the same manner as preparation of the silver halide emulsion 1 except that the liquid temperature during formation of particles was changed from 34° C. to 49° C., the solution C was added for 30 minutes, and potassium iron (II) hexacyanide was removed. Precipitation, desalination, rinsing and dispersion processes were carried out in the same manner as preparation of the silver halide emulsion 1. Spectral sensitization and chemical sensitization are carried out, and 5-methyl-2-mercaptobenzoimidazole and 1-phenyl-2-heptyl-5-mercapto-1,3,4-triazole are added in the same manner as preparation of the emulsion 1 to obtain the silver halide emulsion 2 except that the amount of spectrum sensitizing pigment A added was changed to $7.5\times10^{-4}$ mole with respect to 1 mole of silver, the amount of tellurium sensitizer B added was changed to $1.1\times10^{-4}$ mole with respect to 1 mole of silver, and the amount of 1-phenyl-2-heptyl-5-mercapto-1,3,4-triazole was changed to $3.3\times10^{-4}$ mole with respect to 1 mole of silver. Emulsion particles of the silver halide emulsion 2 were pure silver bromide cubic particles having a ball-equivalent average size of 0.080 μm and a ball-equivalent coefficient of size variation of 20%.

<Preparation of Silver Halide Emulsion 3>

A silver halide emulsion 3 was prepared in the same manner as preparation of the silver halide emulsion 1 except that the liquid temperature during formation of particles was changed from 34° C. to 27° C. In addition, precipitation, desalination, rinsing and dispersion processes were carried out in the same manner as preparation of the silver halide emulsion 1. The silver halide emulsion 3 was obtained in the same manner as the emulsion 1 except that the amount of added solid dispersion of spectrum sensitizing pigment A (gelatin aqueous solution) was changed to $6\times10^{-3}$ mole with respect to 1 mole of silver, and the amount of tellurium sensitizer B added was changed to $5.2\times10^{-4}$ mole with respect to 1 mole of silver. Emulsion particles of the silver halide emulsion 3 were pure silver bromide cubic particles having a ball-equivalent average size of 0.038 μm and a ball-equivalent coefficient of size variation of 20%.

<Preparation of Mixed Emulsion A for Coating Liquid>

70% by weight of silver halide emulsion 1, 15% by weight of silver halide emulsion 2 and 15% by weight of silver halide emulsion 3 were dissolved, and 1 wt % aqueous solution of bemzothiazoriumiodide was added in the amount of $7\times10^{-3}$ mole with respect to 1 mole of silver.

<Preparation of Flake-Shaped Aliphatic Silver Salt>

87.6 kg of behenic acid manufactured by Henkel Co., Ltd. (trade name: Edenor C22-85R), 423 L of distilled water, 49.2 L of 5N-NaOH aqueous solution and 120 L of tert-butanol were mixed together, and were stirred and made to react at 75° C. for 1 hour to obtain a sodium behanate solution. On the other hand, 206.2L of aqueous solution of 40.4 kg of silver nitrate (pH 4.0) was prepared and kept at a temperature of 10° C. A reaction container containing 635 L of distilled water and 30 L of tert-butanol was kept at a temperature of 30° C., and a total amount of the above described sodium behanate solution and a total amount of silver nitrate aqueous solution were added thereto at a fixed flow rate for 62 minutes and 10 seconds and 60 minutes, respectively while stirring. At this time, only the silver nitrate aqueous solution was added for 7 minutes and 20 seconds after the addition of the silver nitrate aqueous solution was started, and thereafter the addition of the sodium behenate solution was started, and only the sodium behenate solution was added for 9 minutes and 30 seconds after the addition of the silver nitrate aqueous solution was completed. At this time, the temperature in the reaction container was 30° C., and the external temperature was controlled so that the liquid temperature was kept constant. In addition, the pipe of the feeding system of the sodium behenate solution was thermally insulated by a steam trace, and the steam aperture was adjusted so that the temperature of liquid at the outlet of the edge of a feeding nozzle was kept at 75° C. In addition, the pipe of the feeding system of the silver nitrate aqueous solution was thermally insulated by circulating chilled water through the outer line of a duplex tube. The position at which the sodium behenate solution was added and the position at which the silver nitrate aqueous solution was added were symmetrical with respect to the mixing axis, and their heights were adjusted so that the solutions did not contact a reaction solution.

The sodium behenate solution was completely added, and was thereafter stirred and left at the same temperature for twenty minutes, and then the temperature was decreased to 25° C. Thereafter, the solid matter was filtered out by centrifugal filtration, and the solid matter was rinsed until the conductivity of the filtrate was 100 μS/cm. In this way, an aliphatic silver salt was obtained. The obtained solid matter was stored as a wet cake without being dried.

The morphology of the obtained behenic acid particles was examined by electron photomicrography, and it was found that the behenic acid particle was a flake-shaped crystal having values of a=0.14 μm, b=0.4 μm and c=0.6 μm, an average aspect ratio of 5.2, a ball-equivalent average diameter of 0.52 μm and a ball-equivalent coefficient of variation of 15% (a, b and c are herein defined).

7.4 g of polyvinyl alcohol (trade name: PVA-217) and water were added to the wet cake equivalent to 100 g of dried solid matter so that the total weight thereof was 385 g, and then the wet cake was subjected to preliminary dispersion processing by a homomixer.

Then, the stock solution subjected to the preliminary dispersion processing was treated three times by a dispersing apparatus (trade name: Micro Fluidizer-M-110S-EH manufactured by Microfluidex International Corporation, using a G10Z interaction chamber) adjusted so that the pressure thereof was kept at 1750 kg/cm$^2$, whereby a behenic acid silver dispersion was obtained. For cooling operation, hose-type heat exchangers were each installed before and after the interaction chamber, the temperature of a coolant was adjusted to set the dispersing temperature at 18° C.

<Preparation of 25 wt % Reducing Agent Dispersion>

16 kg of water was added to 10 kg of 1,1-bis (2-hydroxy-3,5-dimethylphenyl)-3,5,5-trimethylhexane and 10 kg of 20 wt % aqueous solution of denatured polyvinyl alcohol (Poval MP203 manufactured by Kuraray Co., Ltd.), and was to sufficiently mixed to prepare a slurry. This slurry was delivered by a diaphragm pump, and was dispersed for 3 hours and 30 minutes by a lateral sand mill (UVM-2 manufactured by IMEX Co., Ltd.) filled with zirconium beads with the average diameter of 0.5 mm, and thereafter 0.2 g of sodium benzoisothiazoriunon and water were added thereto to make an adjustment so that the concentration of the reducing agent was 25 wt %, whereby a reducing agent dispersion was obtained. Reducing agent particles contained in the reducing agent dispersion obtained in this way had a median diameter of 0.42 μm and the maximum particle size of 2.0 μm or smaller. The obtained reducing agent dispersion was filtered by a polypropylene filter with the pore size of 10 μm to remove foreign materials, and was then stored.

<Preparation of 10 wt % Mercapto Compound Dispersion>

8.3 kg of water was added to 5 kg of 1-phenyl-2-heptyl-5-mercapto-1,3,4-triazole and 5 kg of 20 wt % aqueous solution of denatured polyvinyl alcohol (Poval MP203 manufactured by Kuraray Co., Ltd.), and was sufficiently mixed to prepare a slurry. This slurry was delivered by a diaphragm pump, and was dispersed for 6 hours by a lateral sand mill (UVM-2 manufactured by IMEX Co., Ltd.) filled with zirconium beads with the average diameter of 0.5 mm, and thereafter water was added thereto to make an adjustment so that the concentration of the mercapto compound was 10 wt %, whereby a mercapto dispersion was obtained. Mercapto compound particles contained in the mercapto compound dispersion obtained in this way had a median diameter of 0.40 μm and the maximum particle size of 2.0 μm or smaller. The obtained mercapto compound dispersion was filtered by a polypropylene filter with the pore size of 10 μm to remove foreign materials, and was then stored. In addition, it was filtered again by the polypropylene filter with the pore size of 10 μm immediately before it was used.

<Preparation of 20 wt % Organic Polyhalogen Compound Dispersion-1>

5 kg of tribromomethylnaphthylsulfone, 2.5 kg of 20 wt % aqueous solution of denatured polyvinyl alcohol (Poval MP203 manufactured by Kuraray Co., Ltd.), 213 g of 20 wt % aqueous solution of sodium triisopropylnaphthalene-sulfonate and 10 kg of water were added and mixed sufficiently to prepare a slurry. This slurry was delivered by a diaphragm pump, and was dispersed for 5 hours by a lateral sand mill (UVM-2 manufactured by IMEX Co., Ltd.) filled with zirconium beads with the average diameter of 0.5 mm, and thereafter 0.2 g of sodium benzoisothiazoriunon and water were added thereto to make an adjustment so that the concentration of the organic polyhalogen compound was 20 wt %, whereby an organic polyhalogen compound dispersion was obtained. Organic polyhalogen compound particles contained in the polyhalogen compound dispersion obtained in this way had a median diameter of 0.36 μm and the maximum particle size of 2.0 μm or smaller. The obtained reducing agent dispersion was filtered by a polypropylene filter with the pore size of 3.0 μm to remove foreign materials, and was then stored.

<Preparation of 25 wt % Organic Polyhalogen Compound Dispersion-2>

An organic polyhalogen compound was prepared in the same manner as preparation of the 20 wt % organic polyhalogen compound dispersion-1 except that 5 kg of tribromomethyl (4-(2,4,6-trimethylphenylsulfonyl) phenyl) sulfone was used instead of 5 kg of tribromomethylnaphthylsulfone, and was dispersed and diluted so that the concentration of the organic polyhalogen compound was 25 wt %, and was filtered. Organic polyhalogen compound particles contained in the organic polyhalogen compound dispersion obtained in this way had a median diameter of 0.38 μm and the maximum particle size of 2.0 μm or smaller. The obtained reducing agent dispersion was filtered by a polypropylene filter with the pore size of 3.0 μm to remove foreign materials, and was then stored.

<Preparation of 30 wt % Organic Polyhalogen Compound Dispersion-3>

An organic polyhalogen compound was prepared in the same manner as preparation of the 20 wt % organic polyhalogen compound dispersion-I except that 5 kg of tribromophenylsulfone was used instead of 5 kg of tribromomethylnaphthylsulfone and the amount of 20 wt % MP203 aqueous solution was changed to 5 kg, and was dispersed and diluted so that the concentration of the organic polyhalogen compound was 30 wt %, and was filtered. Organic polyhalogen compound particles contained in the organic polyhalogen compound dispersion obtained in this way had a median diameter of 0.41 μm and the maximum particle size of 2.0 μm or smaller. The obtained reducing agent dispersion was filtered by a polypropylene filter with the pore size of 3.0 μm to remove foreign materials, and was then stored. Thereafter it was stored at a temperature of 10° C. or lower until it was used.

<Preparation of 5 wt % Solution of Phthalazine Compound>

8 kg of denatured polyvinyl alcohol MP203 manufactured by Kuraray Co., Ltd. was dissolved in 174.57 Kg of water, and then 3.15 Kg of 20 wt % aqueous solution of sodium triisopropylnaphthalenesulfonate and 14.28 Kg of 70 wt % aqueous solution of 6-isopropylphthalazine were added thereto to prepare 5 wt % solution of 6-isopropylphthalazine.

<Preparation of 20 wt % Pigment Dispersion>

250 g of water was added to 64 g of C.I. Pigment Blue 60 and 6.4 g of Demor N manufactured by Kao Corp., and was sufficiently mixed to prepare a slurry. 800 g of zirconium beads with the average diameter of 0.5 mm were prepared, and put in a vessel together with the slurry, and were dispersed for 25 hours by a dispersing apparatus (1/4 G Sand Grainder Mill manufactured by IMEX Co., Ltd.) to obtain a pigment dispersion. Pigment particles contained in the pigment dispersion obtained in this way had an average particle size of 0.21 μm.

<Preparation of 40 wt % SBR latex>

An SBR latex purified by ultrafiltration (UF) was obtained in the following manner.

A solution prepared by diluting the SBR latex described below to ten parts with distilled water was diluted and purified until the ion conductivity reached 1.5 mS/cm using a UF-purifying module FS03-FC-FUY03A1 (manufactured by Daisen Membrane System Co., Ltd.), and Sandet-BL manufactured by Sanyo Chemical Co., Ltd. was added so that the concentration thereof was 0.22 wt %. Further, NaOH and $NH_4OH$ were added so that the ratio between $Na^+$ ion and the $NH_4^+$ ion was $Na^+$ ion: $NH_4^+$ ion=1:2.3 (molar ratio) to make an adjustment so that the pH was kept at 8.4. The concentration of latex at this time was 40 wt %. (SBR Latex: Latex of -St(68)-Bu(29)-AA(3)-)<<Preparation of Emulsion Layer (Photosensitive Layer) Coating liquid>

First, 5.5 kg of the 20 wt % pigment aqueous dispersion was delivered into the agitation tank of the preparation and deaeration apparatus, and thereafter 515 kg of organic acid silver dispersion was added with the position of the outlet of the delivery pipe in the agitation tank set at a location about 3 cm below than the surface of the first delivered pigment aqueous dispersion. Subsequently, 25 kg of 20 wt % aqueous solution of polyvinyl alcohol PVA-205 (manufactured by Kuraray Co., Ltd.), 125 kg of 25 wt % reducing agent dispersion described above, total 81.5 kg of organic polyhalogen compound dispersions-1, -2 and -3 in the ratio of 5:1:3 (weight ratio), 31 kg of 10% mercapto compound dispersion, 530 kg of 40 wt % SBR latex subjected to ultrafiltration (UF) and pH adjustment, and 90 L of 5 wt % solution of butadiene compound were each added to prepare a mother liquid of coating liquid. In this case, the position of the outlet of the delivery pipe in the constituent liquid of coating liquid of 20 wt % aqueous solution of polyvinyl alcohol PVA-205 (manufactured by Kuraray Co., Ltd.) was slid so that it was located about 20 cm below the liquid surface. A tank having an inner diameter of 160 cm was used as the agitation tank, and a turbine blade having a diameter of 40 cm was used as the mixing blade. The agitation tank had a jacket, and the temperature in the tank was kept at 35° C. by circulating thermal insulation water. After all constituent liquids of coating liquid were delivered into the agitation tank, the pressure in the agitation tank was reduced to 30 kPa of absolute pressure, and the liquids were stirred and mixed by the turbine blade with the rotation speed of 100 rpm for 180 minutes.

Then, immediately before the mixing container in the inflow pipe through which the mother liquid of coating liquid was delivered to the inline mixer, 50 kg of silver halide mixture emulsion A was delivered and added from the feeding line, and was mixed in the inline mixer to prepare an emulsion layer coating liquid.

EXAMPLES

Examples in which coating liquids for photothermographic materials were produced using the production apparatus of FIG. 1, and Comparative Examples contrasted therewith will now be described.

For the mother liquid of coating liquid, solutions other than the silver halide particle feeding solution mixed by the preparation and deaeration apparatus in the above described "preparation of emulsion layer (photosensitive layer) coating liquid" were used. For the silver halide particle feeding solution, a silver halide mixture emulsion A obtained by mixing the emulsions prepared in "preparation of silver halide emulsion 1", "preparation of silver halide emulsion 2" and "preparation of silver halide emulsion 3".

For the rate at which liquid was delivered to the inline mixer, the mother liquid of coating liquid was delivered to the mixing container at a rate of 20 minute, and the silver halide particle feeding solution was delivered at a rate of 0.7 L/minute. Also, for conditions of the inline mixer (hereinafter referred to as "improved mixer") used in the production apparatus of the present invention, the mixing container is spherical in shape, the mixing blade having sector mixing vanes is driven in a reciprocal manner, the magnitude of the gap between the inner surface of the mixing container and the mixing blade was 10 mm, and the speed of rotation of the mixing blade is 300 cpm.

Operation conditions and evaluation results are shown in Table 1. Evaluation criteria in Table 1 are described below.

Acceptable (A): satisfactory in both photographing performance (sensitivity/fogging) and surface conditions of the coated film.

Unacceptable (F): unsatisfactory in photographing performance (sensitivity/fogging) and surface conditions of the coated film.

TABLE 1

| | Type of inline mixer | Duration between addition and coating | Distance between mixer and feeding port | Photographing performance and surface conditions of coating film |
|---|---|---|---|---|
| Example 1 | Improved mixer | 30 min. | 10 cm | A |
| Example 2 | Improved mixer | 10 min. | 10 cm | A |
| Example 3 | Improved mixer | 5 min. | 10 cm | A |
| Example 4 | Improved mixer | 5 min. | 50 cm | A |
| Example 5 | Improved mixer | 5 min. | 80 cm | A |
| Example 6 | Improved mixer | 5 min. | 100 cm | F |
| Comparative Example 1 | Static mixer* | 5 min. | 50 cm | F |
| Comparative Example 2 | Improved mixer | 60 min. | 50 cm | F |
| Comparative Example 3 | Improved mixer | 10 min. | 150 cm | F |

*Note: For the static mixer, a 20A 12 stage mixer was used.

Evaluation results in Table 1 will now be described.

For Example 1, the improved mixer is used as a mixer (condition (1)), the duration between the time when the silver halide particle feeding solution is added and the time when the coating liquid is allied by the coating head is 30 minutes (condition (2)), and the distance between the improved mixer and the feeding port is 10 cm (condition (3)), with all conditions representing a test section satisfying the condition of the present invention. The evaluation result is rated as A, which shows that both performance (sensitivity/fogging) and surface conditions of the coated film were satisfactory. Example 2 is same as Example 1 except that the duration of condition (2) is 10 minutes, representing a test section satisfying the condition of the present invention. The evaluation result is rated as A, which shows that both performance (sensitivity/fogging) and surface conditions of the coated film were satisfactory.

Example 3 is same as Example 1 except that the duration of condition (2) is 5 minutes, representing a test section satisfying the condition of the present invention. The evaluation result is rated as A, which shows that both performance (sensitivity/fogging) and surface conditions of the coated film were satisfactory.

Example 4 is same as Example 1 except that the duration of condition (2) is 5 minutes and the distance of condition (3) is 50 cm, representing a test section satisfying the condition of the present invention. The evaluation result is rated as A, which shows that both performance (sensitivity/fogging) and surface conditions of the coated film were satisfactory.

Example 5 is same as Example 1 except that the duration of condition (2) is 5 minutes and the distance of condition (3) is 80 cm, representing a test section satisfying the condition of the present invention. The evaluation result is rated as A, which shows that both performance (sensitivity/fogging) and surface conditions of the coated film were satisfactory.

Example 6 is same as Example 1 except that the duration of condition (2) is 5 minutes and the distance of condition (3) is 100 cm, representing a test section satisfying the condition of the present invention. The evaluation result is rated as A, which shows that both performance (sensitivity/fogging) and surface conditions of the coated film were satisfactory. Comparative Example 1 represents the case where a conventional static mixer is used as an inline mixer. The evaluation result is rated as F, which specifically indicates poor surface conditions of the coated film ascribable to poor mixing performance.

Comparative Example 2 represents the case where conditions (1) and (3) described in Example 1 satisfy the condition of the present invention, but the duration between the time when the silver halide particle feeding solution is added and the time when the coating liquid is applied by the coating head is 60 minutes in condition (2), which does not satisfy the condition of the present invention. The evaluation result is rated as F, which specifically indicates reduction in photographing performance (reduction in sensitivity/high level of fogging).

Comparative Example 3 represents the case where conditions (1) and (2) described in Example 1 satisfy the condition of the present invention, but the distance between the improved mixer and the feeding port is 150 cm in condition (3), which does not satisfy the condition of the present invention. The evaluation result is rated as F, which specifically indicates poor surface conditions ascribable to coagulation of components of coating liquid.

As described above, according to the method and apparatus for producing a coating liquid for photothermographic materials of the present invention, a coating liquid for photothermographic materials excellent in photographing performance with high sensitivity and reduced fogging and having satisfactory surface conditions can be produced.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for producing a coating liquid for photothermographic materials, the method comprising the steps of:

adding and mixing a silver halide particle feeding solution in a mother liquid of coating liquid containing at least an organic silver salt, a reducing agent for silver ions and a polymer latex, wherein a mixing blade is driven in a reciprocal manner so that a portion of retained liquid is eliminated for the mixing.

2. The method according to claim 1, wherein the silver halide particle feeding solution is added and mixed in the mother liquid of coating during a time period between an instant 30 minutes before a substrate is coated with the produced coating liquid by a coating head and an instant just before the coating is started.

3. An apparatus for producing a coating liquid for photothermographic materials, the apparatus comprising:

a feeding apparatus and an inline mixer for adding and mixing a silver halide particle feeding solution in a mother liquid of coating liquid containing at least an organic silver salt, a reducing agent for silver ions and a polymer latex, wherein the inline mixer comprising:

a mixing container having an inner surface of one of a spherical shape, an oblate-spherical shape and a prolate-spherical shape;

an inlet for the liquid formed in the mixing container;

an outlet formed in the mixing container for discharging a mixed liquid;

a mixing blade supported by a rotation axis in the mixing container and formed so that the blade has a circular or parabolic shape; and a driving device which drives the rotating axis in reciprocal manner by alternation, wherein the mixing blade forms a mixing area in proximity to any part of the inner surface of the mixing container when the rotation axis is driven.

4. The apparatus according to claim 3, wherein a feeding pipe of the feeding apparatus is connected to an inlet pipe to the inline mixer at a position within 100 cm from the inline mixer.

5. The apparatus according to claim 3, wherein a mixing speed of the mixing blade is in a range of from 100 to 1000 cpm.

6. The apparatus according to claim 3, wherein the feeding apparatus has a circulation line through which the silver halide particle feeding solution is circulated.

* * * * *